US007976354B2

(12) United States Patent
Kubota et al.

(10) Patent No.: US 7,976,354 B2
(45) Date of Patent: Jul. 12, 2011

(54) OUTBOARD MOTOR

(75) Inventors: Mitsuaki Kubota, Saitama (JP); Takeshi Inaba, Saitama (JP); Yoshio Ohtomo, Saitama (JP); Hikaru Ikeda, Saitama (JP); Hideaki Shimamura, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 178 days.

(21) Appl. No.: 12/424,328

(22) Filed: Apr. 15, 2009

(65) Prior Publication Data

US 2009/0264032 A1 Oct. 22, 2009

(30) Foreign Application Priority Data

Apr. 17, 2008 (JP) ..... 2008-108084
Apr. 17, 2008 (JP) ..... 2008-108106

(51) Int. Cl.
*F02B 61/04* (2006.01)

(52) U.S. Cl. ..... 440/87; 440/63

(58) Field of Classification Search ..... 440/53, 440/63, 84, 86, 87, 52
See application file for complete search history.

(56) References Cited

U.S. PATENT DOCUMENTS

| | | | | |
|---|---|---|---|---|
| 4,337,053 | A | 6/1982 | Stevens | |
| 5,797,777 | A * | 8/1998 | Tsunekawa et al. | 440/84 |
| 6,093,066 | A * | 7/2000 | Isogawa et al. | 440/63 |
| 6,406,342 | B1 * | 6/2002 | Walczak et al. | 440/84 |
| 6,491,555 | B2 * | 12/2002 | Kitsu et al. | 440/87 |
| 7,214,113 | B2 * | 5/2007 | Kojima | 440/87 |
| 7,442,104 | B2 * | 10/2008 | Okabe | 440/86 |

FOREIGN PATENT DOCUMENTS

| | | | |
|---|---|---|---|
| JP | H02-14235 | B2 | 4/1990 |
| JP | 2005-319881 | A | 11/2005 |
| JP | 2006-205789 | A | 8/2006 |

* cited by examiner

*Primary Examiner* — Lars A Olson
(74) *Attorney, Agent, or Firm* — Arent Fox LLP

(57) ABSTRACT

An operating handle of an outboard motor is provided with a rotatable grip and a low-speed mode switch unit. A controller performs control so that when the low-speed mode switch unit is "on," the ratio at which the target speed varies with the manipulated variable of the grip is reduced in comparison with when the low-speed mode switch unit is "off."

10 Claims, 15 Drawing Sheets

OUTBOARD MOTOR

FIELD OF THE INVENTION

The present invention relates to a technique for controlling the speed of an engine of an outboard motor.

BACKGROUND OF THE INVENTION

An outboard motor is mounted at the rear of the hull of a small-sized marine vessel. An outboard motor is provided with a horizontal, bar-shaped steering handle. Known examples of such outboard motors are disclosed in Japanese Patent Application Laid-Open Publication No. 2005-319881 (JP 2005-319881 A) and Japanese Patent Post-Exam Publication No. H02-014235 (JP H02-014235 B).

The outboard motors disclosed in JP 2005-319881 A and JP H02-014235 B have a rotatable grip at the distal end of the steering handle. The degree of opening of the throttle valve can be adjusted by rotating the grip. The speed of the engine changes as a result. The boat pilot simultaneously performs two operations with one hand; that is, rotates the grip to adjust the degree of opening of the throttle valve while holding the grip to steer.

In the case of trawling (trawl fishing) and the like, the speed of the vessel is finely adjusted according to conditions. There is therefore a need for the ability to finely adjust the speed of the engine. Finely adjusting the engine speed while steering the vessel for a long period of time places a significant burden on the boat pilot, and requires that the pilot have experience. A significant amount of training is needed, particularly for a novice to be able to easily pilot the vessel.

The outboard motors described above are therefore provided with a separate operating member for fine adjustment at low speed. However, since the separate operating member is finely adjusted by a mechanical structure, the structure is complex, and there is potential for further improvement thereof.

The outboard motor disclosed in Japanese Patent Application Laid-Open Publication No. 2006-205789 (JP 2006-205789 A) also has a rotatable grip at the distal end of the steering handle. The degree of opening of the throttle valve can be adjusted by rotating the grip. The speed of the engine changes as a result. The boat pilot simultaneously performs two operations with one hand; that is, rotates the grip to adjust the degree of opening of the throttle valve while holding the grip to steer. Experience is required for the boat pilot to be able to hold the engine speed constant while steering the boat for long periods of time.

The outboard motor disclosed in JP 2006-205789 A is therefore provided with a mechanical handle adjustment mechanism so that the grip does not rotate during steering. As a result, it is relatively easy to keep the speed of the engine constant. However, since a mechanical structure prevents the grip from rotating, the structure is complex, and there is potential for further improvement thereof.

SUMMARY OF THE INVENTION

An object of the present invention is to provide an outboard motor whereby the speed of the engine can be finely adjusted and piloting can be facilitated by a simple structure.

Another object of the present invention is to provide an outboard motor whereby the speed of the engine can be held constant and piloting can be facilitated by a simple structure.

According to a first aspect of the present invention, there is provided an outboard motor wherein opening/closing of a throttle valve is electrically controlled so that the actual speed of an engine for driving a propeller conforms to a target speed, which outboard motor comprises: a manually operatable low-speed mode switch unit provided to a steering handle; a rotatable grip provided to a distal end of the steering handle; a grip operation detector for detecting the manipulated variable of the grip; and a controller for setting the target speed in accordance with the manipulated variable detected by the grip operation detector and controlling the opening/closing of the throttle valve so that the actual speed conforms to the target speed; wherein the controller performs control so that when a switching signal is received from the low-speed mode switch unit, the ratio at which the target speed varies with the manipulated variable is reduced in comparison with when a switching signal is not received.

The controller sets the target speed in accordance with the grip manipulated variable detected by the grip operation detector, and controls the opening/closing of the throttle valve so that the actual speed conforms to the target speed. The low-speed mode switch unit issues an electrical switching signal in accordance with the actions of the pilot. When the switching signal is received from the low-speed mode switch unit, the controller reduces the ratio at which the target speed varies with the manipulated variable in comparison with when the switching signal is not received.

In other words, the ratio at which the target speed varies with the manipulated variable of the grip is reduced by the simple operation of merely operating the low-speed mode switch unit. The target speed does not increase even when the grip is operated to the furthest possible extent. The target speed can therefore be finely adjusted. Since the engine speed can be finely adjusted in a low-speed range, the speed of a vessel can be finely adjusted during trawling (trawl fishing). Even a novice can easily pilot the vessel. The low-speed mode switch unit also merely issues an electrical switching signal in accordance with the operation of the pilot, and can therefore have a simple structure.

Preferably, the controller performs control so as to maintain the target speed of the time immediately prior to when the switching signal had ceased to be received, at the time at which the switching signal is no longer received from the low-speed mode switch unit. In other words, the controller ceases to receive the switching signal from the low-speed mode switch unit when the pilot deactivates the low-speed mode switch unit. At this time, the controller maintains the target speed of the time immediately before the switching signal ceased to be received. There is therefore no sudden change in the target speed when the low-speed mode switch unit is deactivated. Since there is no sudden change in the speed of the engine, the pilot can pilot the vessel more stably.

Desirably, the controller is configured so as to gradually change from the maintained target speed to a target speed that is in accordance with a changed manipulated variable when the manipulated variable has changed after the switching signal has ceased to be received from the low-speed mode switch unit. The pilot rotates the grip after deactivating the low-speed mode switch unit, and the target speed is thereby changed in accordance with the manipulated variable of the grip. In this case, the controller performs control so as to gradually change from the maintained target speed to the target speed that is in accordance with the changed manipulated variable. After the pilot has deactivated the low-speed mode switch unit, the target speed is changed only by intentional rotation of the grip. The target speed also gradually changes. The pilot can therefore pilot the vessel even more stably.

In a preferred form, the low-speed mode switch unit comprises a manually operated switch disposed in the vicinity of the grip. The structure of the low-speed mode switch unit can thus be further simplified.

Preferably, the steering handle is provided with a display unit for displaying the actual speed and the target speed. Consequently, it is always easy for the pilot to visually confirm the speed while piloting the vessel.

According to another aspect of the present invention, there is provided an outboard motor wherein opening/closing of a throttle valve is electrically controlled so that the actual speed of an engine for driving a propeller conforms to a target speed; the outboard motor comprising: a manually operatable constant-speed setting unit provided to a steering handle; a rotatable grip provided to a distal end of the steering handle; a grip operation detector for detecting the manipulated variable of the grip; and a controller for setting the target speed in accordance with the manipulated variable detected by the grip operation detector and controlling the opening/closing of the throttle valve so that the actual speed conforms to the target speed; wherein the controller performs control so that the target speed at the time the constant-speed setting unit changes from "off" to "on" is maintained when the constant-speed setting unit is "on," even when the manipulated variable changes.

Consequently, the speed of the engine can be kept constant by the simple operation of merely operating the constant-speed setting unit. Therefore, the vessel can easily be piloted. The constant-speed setting unit also merely issues an electrical setting signal in accordance with the operation of the pilot, and can therefore have a simple structure.

Preferably, the controller performs control so that the maintained target speed continues to be maintained unchanged at the time the constant-speed setting unit changes from "on" to "off." When the pilot has deactivated the constant-speed setting unit, the controller continues to maintain the maintained target speed. Therefore, there is no sudden change in the target speed when the constant-speed setting unit is deactivated. Since there is no sudden change in the speed of the engine, the pilot can pilot the vessel more stably.

Desirably, the controller performs control so that the maintained target speed gradually changes to a target speed that is in accordance with a changed manipulated variable when the manipulated variable has changed after the constant-speed setting unit has changed from "on" to "off." After the pilot has deactivated the constant-speed setting unit, the target speed is changed only by intentional rotation of the grip. The target speed also gradually changes. The pilot can therefore pilot the vessel even more stably.

In a preferred form, the constant-speed setting unit comprises a manually operated switch disposed in the vicinity of the grip. The structure of the constant-speed setting unit can therefore be further simplified.

Preferably, the steering handle is provided with a display unit for displaying the actual speed and the target speed. Consequently, it is always easy for the pilot to visually confirm the speed while piloting the vessel.

BRIEF DESCRIPTION OF THE DRAWINGS

Certain preferred embodiments of the present invention will be described in detail below, by way of example only, with reference to the accompanying drawings, in which.

DESCRIPTION OF THE PREFERRED EMBODIMENTS

Figure 1:
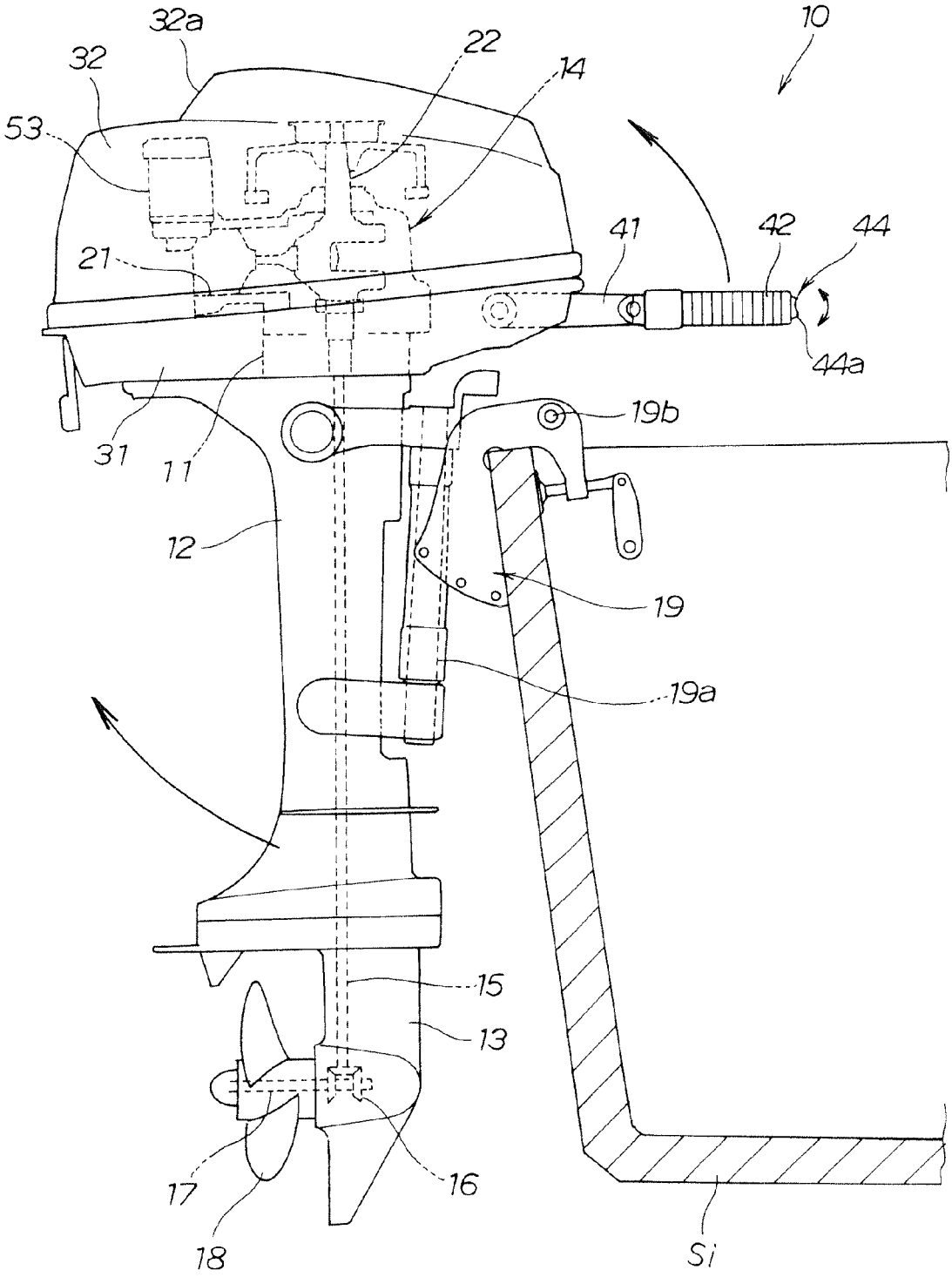
FIG. 1 is a side elevational view showing an outboard motor according to a first embodiment of the present invention.
Figure 2:
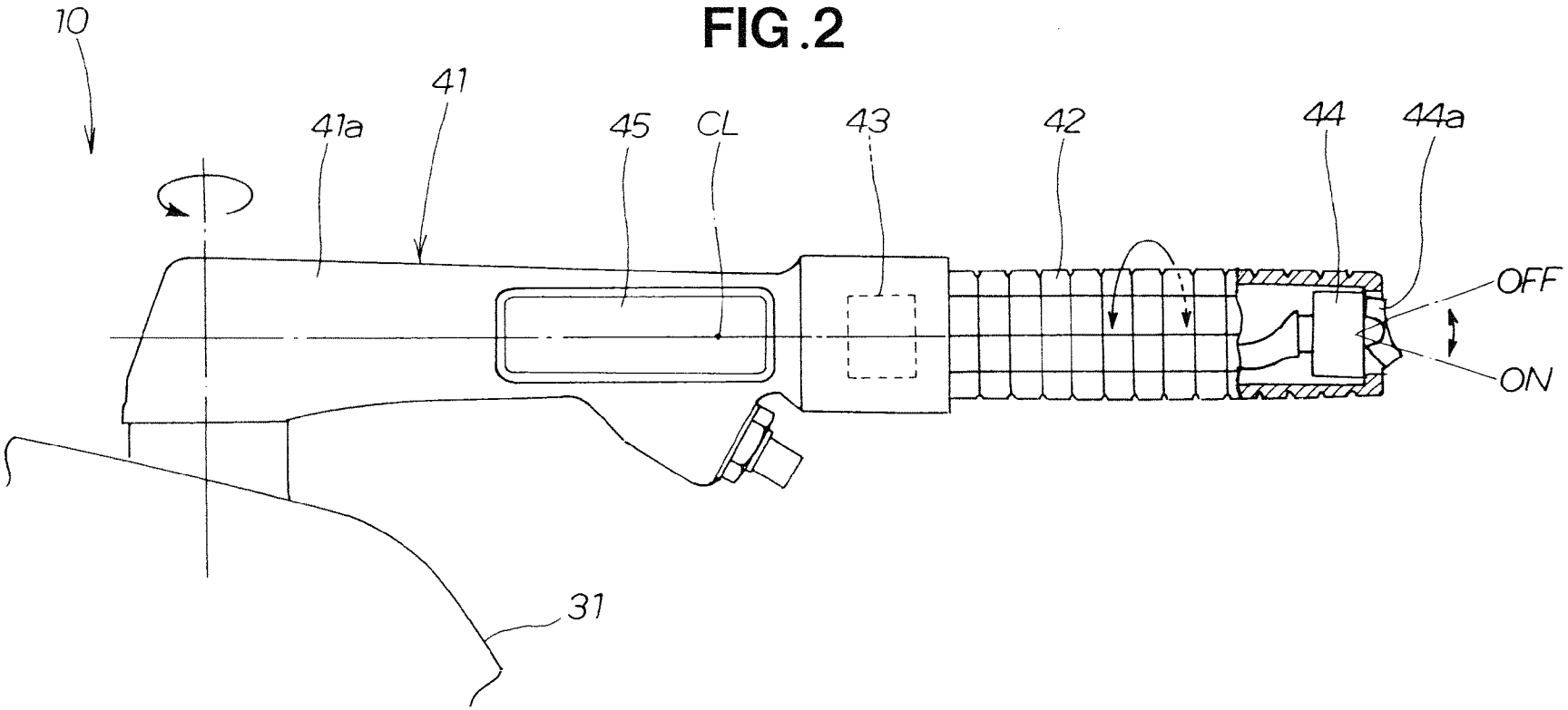
FIG. 2 is a top plan view showing a steering handle of FIG. 1.

As shown in FIGS. 1 and 2, the outboard motor 10 of the first embodiment is composed of a mounting case 11, an extension case 12, a gear case 13, an engine 14, a drive shaft 15, a gear mechanism 16, a propeller shaft 17, a propeller 18, and an outboard motor attachment mechanism 19.

The mounting case 11 is a so-called engine support case, on the upper surface of which the engine 14 is attached. The extension case 12 is attached to the bottom of the mounting case 11. The gear case 13 is attached to the bottom of the extension case 12. The engine 14 is a vertical-type engine (e.g., a single-cylinder engine) in which the axis of the cylinder 21 is sideways (substantially horizontal), and the crank shaft 22 is vertically oriented. The drive shaft 15 is accommodated in the extension case 12, and extends downward from the crank shaft 22 and transmits the power of the engine 14 to the propeller 18 via the gear mechanism 16 and the propeller shaft 17.

The engine 14 is covered by an under case 31 on the bottom and an engine cover 32 on the top. The engine cover 32 has a fresh-air intake port 32*a* at the top thereof. Outside air is taken into the engine cover 32 from the fresh-air intake port 32*a*. A throttle valve 53 for the engine 14 is also accommodated inside the engine cover 32.

The outboard motor attachment mechanism 19 fixes the outboard motor 10 to a hull Si and enables the outboard motor 10 to swing about a swivel shaft 19*a* to the left and right as viewed in a plane, and the outboard motor 10 including the swivel shaft 19*a* can also be lifted up in the clockwise direction in the drawing about a tilt shaft 19*b*.

The under case 31 is also provided with a substantially horizontal bar-shaped steering handle 41 on the side of the front (the hull Si side) of the under case 31. The steering handle 41 (tiller handle 41) can be set to a substantially horizontal use position indicated by solid lines, and can be swung counterclockwise in the drawing from the use position to a substantially vertical storage position.

As shown in FIGS. 1 and 2, the steering handle 41 of the outboard motor 10 in the first embodiment is provided with a grip 42, a grip operation detector 43, a low-speed mode switch unit 44, and a display unit 45.

The grip 42 is positioned at the distal end of the bar-shaped steering handle 41, and is attached so as to be able to rotate about the axis CL of the steering handle 41. The grip operation detector 43 detects the actual manipulated variable θr (FIG. 3) when the grip 42 is rotated, and is provided inside the steering handle 41. The grip operation detector 43 is composed of a variable resistor for issuing a voltage signal proportional to the manipulated variable θr (operation angle θr) of the grip 42.

The low-speed mode switch unit 44 is set when the pilot wishes to switch the speed control mode of the engine 14 to a predetermined low-speed mode (a control mode for finely adjusting the speed of the engine 14; a trawling mode), and is composed of a manually operated switch that is operated by the pilot. Since the low-speed mode switch unit 44 is formed by a manually operated switch positioned in the vicinity of the grip 42, the structure of the low-speed mode switch unit 44 can be further simplified.

The manually operated switch is composed of a rocker switch, for example. This rocker switch is also referred to as a seesaw switch or a tumbler switch. In specific terms, the low-speed mode switch unit 44 composed of a rocker switch is a switch whereby a connecting circuit is switched by pressing one side of an operating knob 44*a* that operates in seesaw fashion. The operating knob 44*a* is switched between two positions that include an "off" position OFF and an "on" position ON at the other end of a seesaw operation from the "off" position OFF, and the operating knob 44*a* maintains the switched position by itself even when no longer pressed after operation.

The switch signal issued by the low-speed mode switch unit 44 is composed of two signals that include an "off" signal and an "on" signal. Specifically, when the operating knob 44*a* is in the "off" position OFF, the low-speed mode switch unit 44 issues the "off" signal (deactivating signal). When the operating knob 44*a* is in the "on" position ON, the low-speed mode switch unit 44 issues the "on" signal (switching signal). The low-speed mode switch unit 44 will be referred to hereinafter as the "low-speed mode switch 44" as appropriate.

The low-speed mode switch unit 44 is provided in a different position of the steering handle 41 than the grip 42. The low-speed mode switch unit 44 is fixed to the distal end surface of the steering handle 41, for example. The low-speed mode switch unit 44 can therefore be operated by the thumb of the hand holding the grip 42, for example.

The low-speed mode switch unit 44 is preferably provided so that the operating knob 44*a* is operated vertically in seesaw fashion when the steering handle 41 is in the substantially horizontal use position, as shown in FIG. 1. Through this arrangement, there is no change in the operation of the operating knob 44*a* regardless of whether the pilot is positioned to the left or the right (the front and back of the paper surface of FIG. 1) of the steering handle 41. The operability of the operating knob 44*a* is therefore enhanced.

It is sufficient insofar as the low-speed mode switch unit 44 is provided in the vicinity of the grip 42 in the steering handle 41, and the low-speed mode switch unit 44 may be provided closer to the swing base 41*a* than the grip 42 in the steering handle 41, for example.

Since the low-speed mode switch unit 44 is provided to the steering handle 41 rather than to the outboard motor 10 as such, the low-speed mode switch unit 44 is positioned closer to the pilot. The low-speed mode switch unit 44 is therefore easy for the pilot to operate.

The display unit 45 is provided in the steering handle 41 closer to the swing base 41*a* than the grip 42, and on the upper surface of the handle.

The grip operation detector 43, the low-speed mode switch unit 44, and the display unit 45 are thus provided to the steering handle 41 rather than to the outboard motor 10 as such, and are therefore less prone to water exposure.

Figure 3:
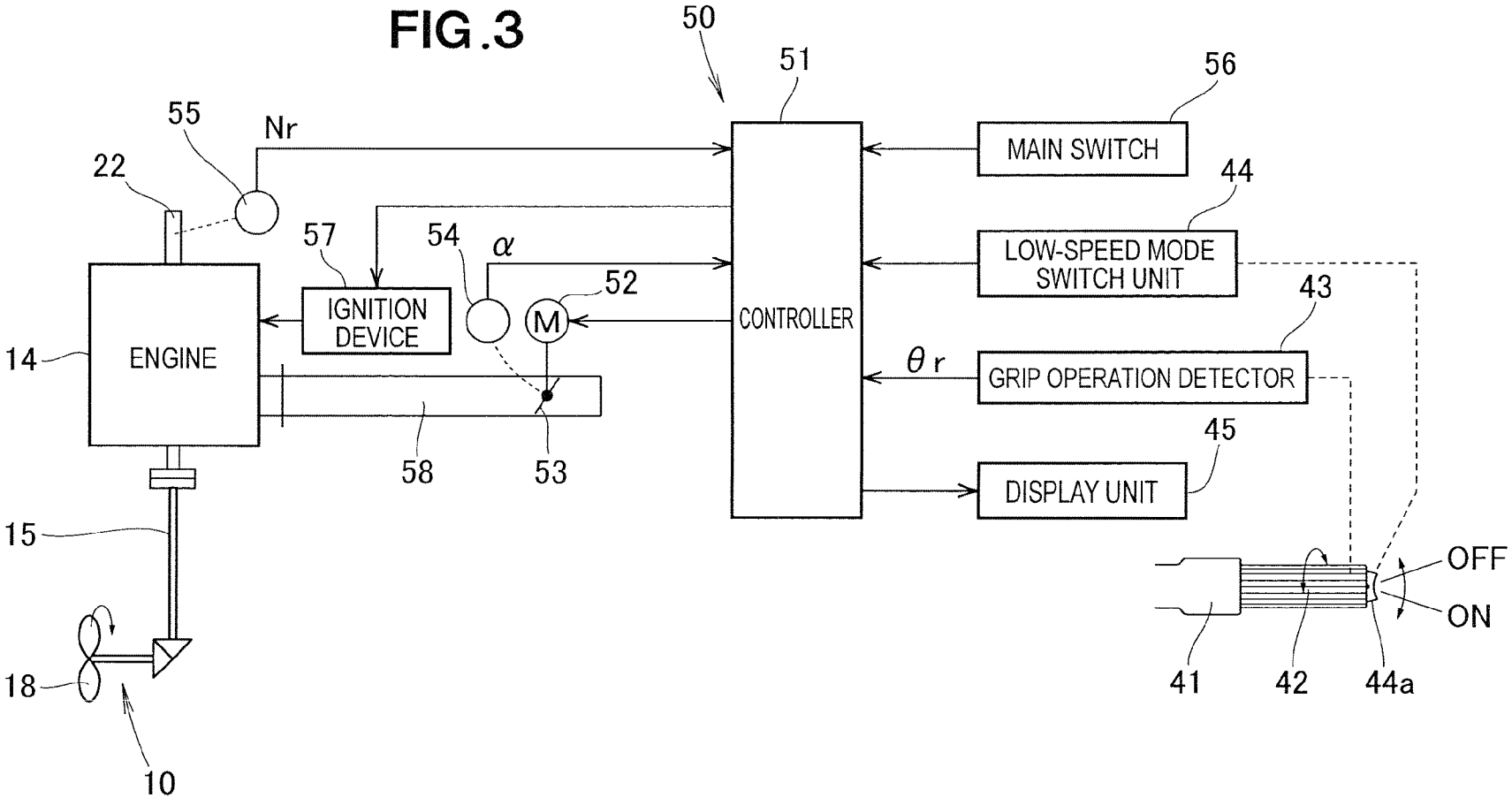
FIG. 3 is a block diagram illustrating an electrical circuit of the outboard motor according to the first embodiment.

As shown in FIG. 3, the outboard motor 10 has the characteristic feature of being equipped with an electronic governor 50 (also referred to as an electric governor or an electronic speed regulator). The electronic governor 50 controls the speed of the engine 14 by automatically adjusting the degree of opening of the throttle valve 53 by an electric motor 52 on the basis of a control signal of a controller 51. The electronic governor 50 is formed by the combination of the controller 51, the electric motor 52, the throttle valve 53, a throttle opening degree sensor 54, and an engine speed sensor 55. The throttle opening degree sensor 54 detects the degree of opening α of the throttle valve 53. The engine speed sensor 55 detects the actual speed Nr of the engine 14.

The controller 51 is an electronic controller for receiving signals from the grip operation detector 43, the low-speed mode switch unit 44, the throttle opening degree sensor 54, the engine speed sensor 55, and a main switch 56, and controlling the engine 14 according to a predetermined control mode, and is a microcomputer, for example. In other words, the controller 51 controls an ignition device 57, sets the target speed Ns in accordance with the manipulated variable θr (operation angle θr) of the grip 42 detected by the grip operation detector 43, and electrically controls the opening and closing of the throttle valve 53 via the electric motor 52 so that the actual speed Nr conforms to the target speed Ns.

Figure 4:
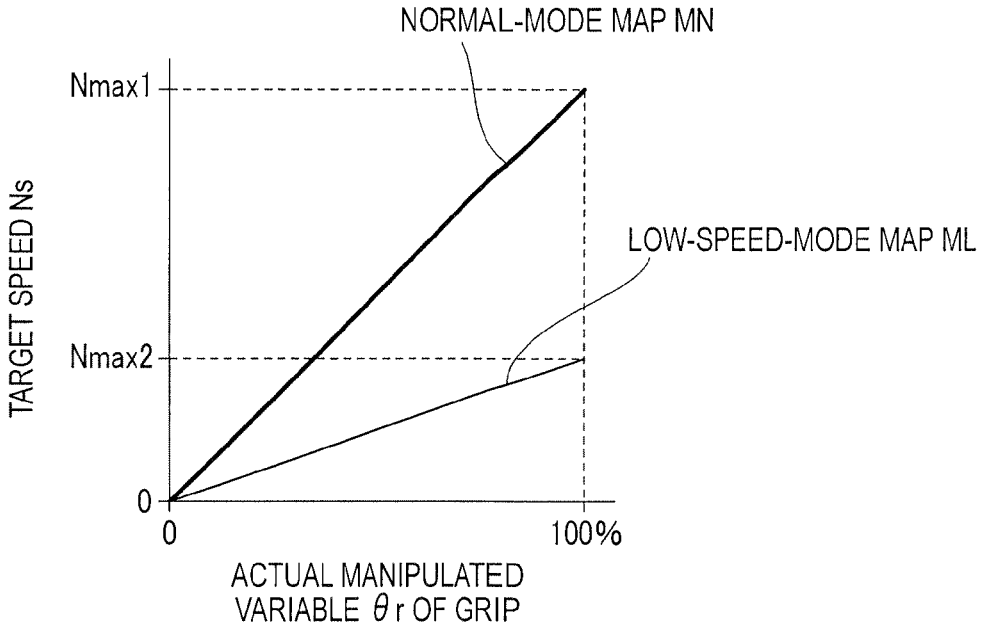
FIG. 4 is a map showing a normal mode and a low-speed mode of a target speed.

FIG. 4 shows the concept whereby the controller 51 shown in FIG. 3 increases and decreases the target speed Ns. The graph of FIG. 4 shows the characteristics of the target speed Ns with respect to the manipulated variable θr, wherein the horizontal axis indicates the actual manipulated variable θr of the grip 42, and the vertical axis indicates the target speed Ns of the engine.

The straight line MN indicated by the bold line sloping upward to the right is the target speed characteristic line in the normal mode, and indicates that the target speed Ns varies with the manipulated variable θr. According to this target speed characteristic line MN in the normal mode, it is apparent that the target speed Ns is at the minimum value of 0 when the manipulated variable θr is at the minimum value of 0, and the target speed Ns is at the maximum value Nmax1 when the manipulated variable θr is at the maximum value 100% (maximum angle). The target speed characteristic line MN in the normal mode can be used as a "normal-mode map MN" when the controller 51 calculates the target speed Ns according to the manipulated variable θr in the normal mode.

The straight line ML indicated by the thin line sloping upward to the right is the target speed characteristic line in the low-speed mode, and indicates that the target speed Ns varies with the manipulated variable θr. According to this target speed characteristic line ML in the low-speed mode, it is apparent that the target speed Ns is at the minimum value of 0 when the manipulated variable θr is at the minimum value of 0, and the target speed Ns is at the maximum value Nmax2 when the manipulated variable θr is at the maximum value 100% (maximum angle). The maximum value Nmax2 in the low-speed mode is a smaller value than the maximum value Nmax1 in the normal mode, and is set to ⅓ the value of Nmax1, for example. The target speed characteristic line ML in the low-speed mode can be used as a "low-speed-mode map ML" when the controller 51 calculates the target speed Ns according to the manipulated variable θr in the low-speed mode.

The controller 51 shown in FIG. 3 is configured so as to perform the following three types of control.

The first control is control performed so that the ratio at which the target speed Ns varies with the manipulated variable θr decreases when the electrical switching signal ("on" signal) is received from the low-speed mode switch unit 44 relative to when the switching signal is not received.

The second control is control performed so as to maintain the target speed Ns of the time immediately prior to when the switching signal had ceased to be received, at the time at which the switching signal is no longer received from the low-speed mode switch unit 44.

The third control is control performed so as to gradually change from the maintained target speed Ns to a target speed Ns that is in accordance with a changed manipulated variable θr when the manipulated variable θr of the grip 42 has changed after the switching signal has ceased to be received from the low-speed mode switch unit 44.

The electric motor 52 (electric actuator 52) is composed of a stepping motor, for example. The throttle valve 53 is provided to an intake passage 58 for feeding combustion air to the engine 14. The amount of combustion air can be adjusted by the throttle valve 53. The main switch 56 turns the power supply to the engine 14 on and off, and is composed of an ignition switch for starting the engine 14.

Figure 5A:
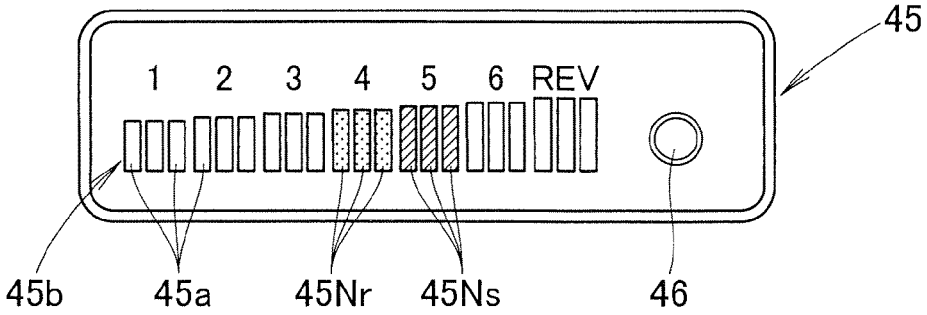
FIGS. 5A and 5B are schematic views showing specific examples of a display unit of FIG. 3.
Figure 5B:
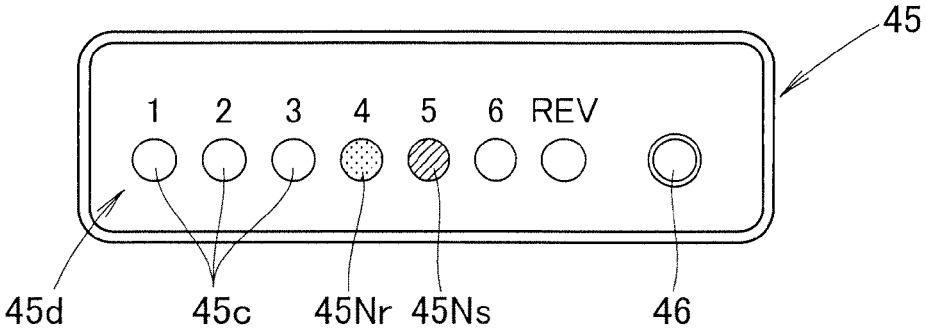

The controller 51 issues a display instruction to the display unit 45 to cause the abovementioned target speed Ns and actual speed Nr to be displayed. FIGS. 5A and 5B show examples of the display unit shown in FIG. 3.

The display unit 45 shown in FIG. 5A displays the speeds Ns, Nr by a display pattern 45*b* in the shape of a barcode formed by arranging a plurality of bar-shaped display segments 45*a* (including indicator lights) in a horizontal row.

The display unit 45 shown in FIG. 5B displays the speeds Ns, Nr by a display pattern 45*d* formed by arranging a plurality of circular display segments 45*c* (including indicator lights) in a horizontal row.

The display patterns 45*b*, 45*d* constitute a display scheme in which the leftmost display segments 45*a*, 45*c* display the lowest speed, and the indicated speed increases to the right in FIGS. 5A and 5B.

The display unit 45 is provided with a control mode display part 46. The control mode display part 46 displays the control mode in which the throttle valve 53 is being controlled by the controller 51 shown in FIG. 3. The control mode display part 46 is lit when the controller 51 is controlling the throttle valve 53 according to the low-speed mode (control mode for finely adjusting the speed of the engine 14; trawling mode) described above. Since the pilot can easily know the current control mode by observing the control mode display part 46, operational errors can be prevented.

Figure 6:
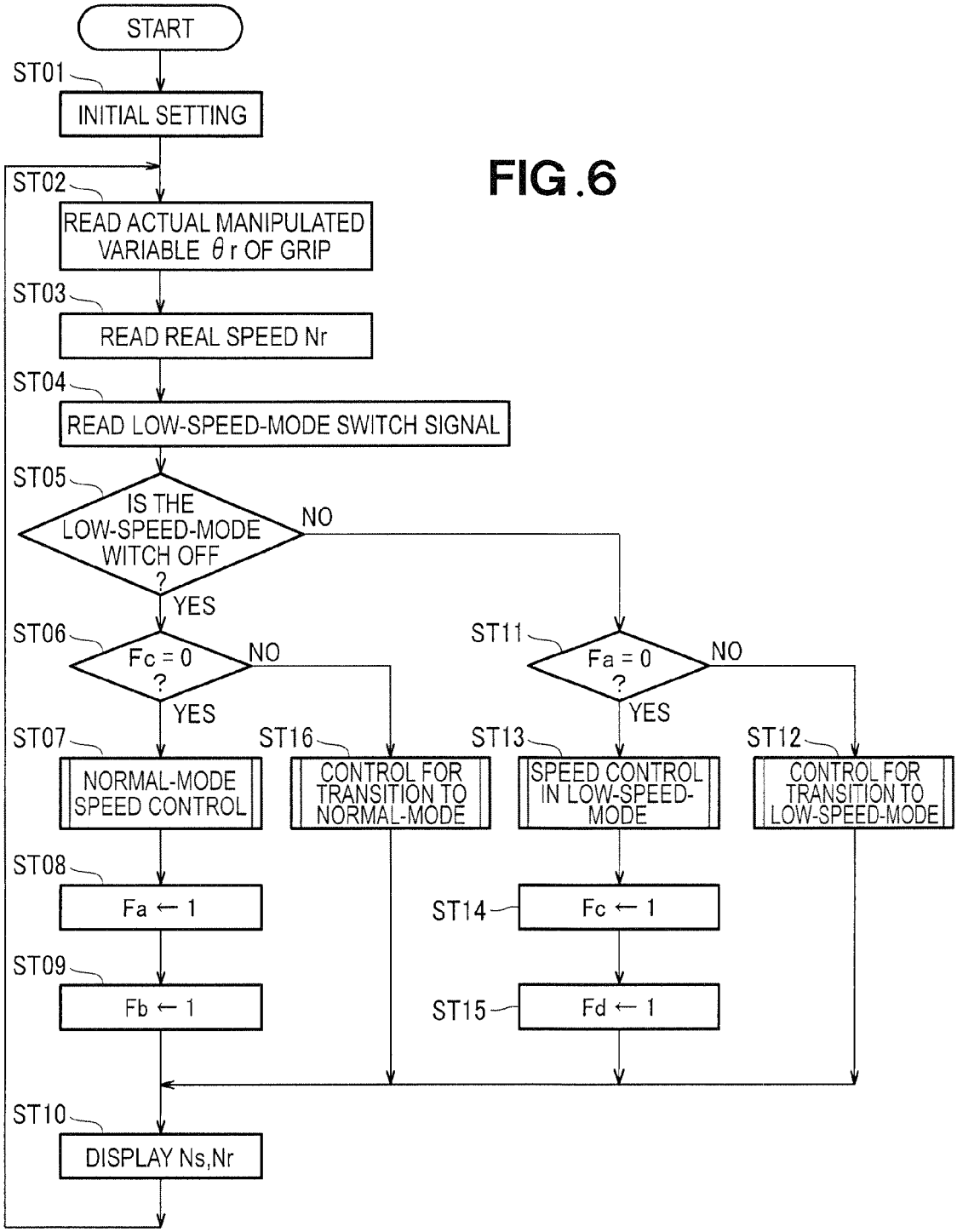
FIG. 6 is a flowchart showing an example control of a throttle valve by a controller of FIG. 3.

The flow of control when the controller 51 (FIG. 3) is a microcomputer will next be described based on FIGS. 6 through 10 and with reference to FIG. 3. FIG. 6 is a control flowchart (main routine) showing an example of the throttle valve control executed by the controller 51 shown in FIG. 3.

After the pilot has started the engine 14 by switching the main switch 56 to the start position and actuating the ignition device 57, when the pilot switches the main switch 56 to the "on" position, the controller 51 initiates control according to the control flow shown in FIG. 6. Control by the controller 51 is then ended by the pilot switching the main switch 56 to the "off" position. This control flow is a closed-loop control flow executed repeatedly at each instance of a predetermined time, e.g., 20 msec.

The low-speed mode switch unit 44 at this time is in the "off" state. In this state, the pilot switches the main switch 56 to the "on" position. When the main switch 56 is turned on, the controller 51 initiates control after an initialization (step ST01). In other words, the system is reset, all flags (first flag Fa, second flag Fb, third flag Fc, fourth flag Fd) are set to 0, and a reference manipulated variable θL is set to a value of 0.

The actual manipulated variable θr of the grip 42 is then read (step ST02). The actual manipulated variable θr of the grip 42 is detected by the grip operation detector 43. The actual speed Nr of the engine 14 is then read (step ST03). The actual speed Nr (real speed Nr) is detected by the engine speed sensor 55. The switch signal of the low-speed mode switch unit 44 is then read (step ST04).

A determination is then made as to whether the switch signal of the low-speed mode switch unit 44 is "off" (step ST05). When the switch signal is determined to be "off" in step ST05, a determination is made as to whether the third flag Fc=0 (step ST06).

When the switch signal is "off" in step ST05, and the third flag Fc=0 in step ST06, a determination is made that the normal mode is in effect, and normal-mode speed control by the pilot is executed (step ST07). This normal-mode speed control (step ST07) will be described in detail using FIG. 7.

Figure 7:
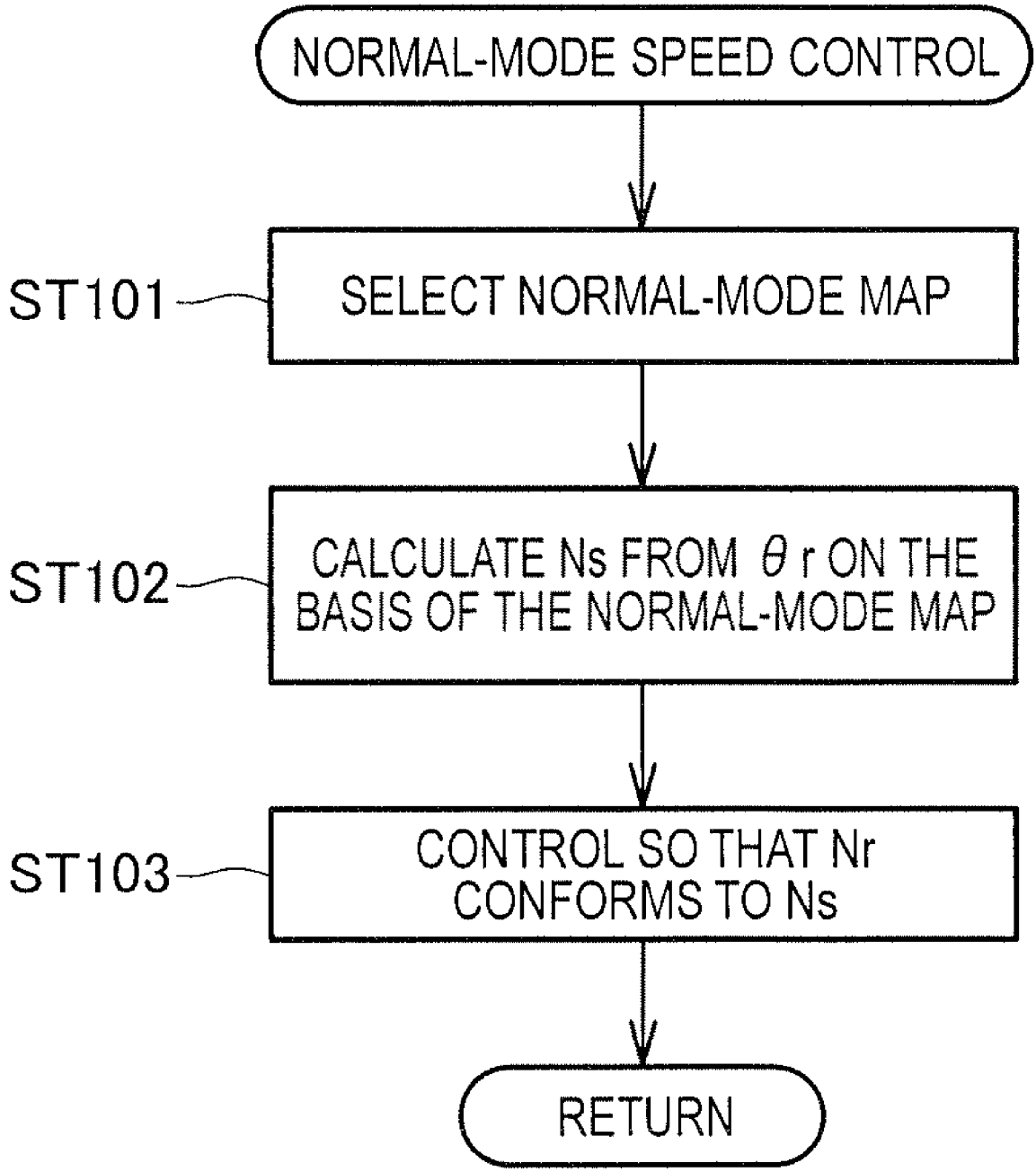
FIG. 7 is a flowchart showing a subroutine for executing speed control (step ST07) of the normal mode shown in FIG. 6.

FIG. 7 is a control flowchart showing a subroutine for executing the normal-mode speed control (step ST07) shown in FIG. 6.

In the subroutine shown in FIG. 7, a "normal-mode map MN" is first selected from the maps shown in FIG. 4 (step ST101). The target speed Ns of the engine 14 is then calculated from the actual manipulated variable θr of the grip 42 on the basis of the normal-mode map MN (step ST102).

Normal speed control by the pilot is then executed (step ST103). In other words, in step ST103, the pilot rotates the grip 42 as appropriate for the piloting conditions, and the controller 51 controls the opening and closing of the throttle valve 53 so that the actual speed Nr conforms to the target speed Ns (speed Ns calculated in step ST102) that corresponds to the manipulated variable θr. Specifically, the opening and closing of the throttle valve 53 are controlled by controlling the driving of the electric motor 52 by PID control or the like. A signal of the opening degree a detected by the throttle opening degree sensor 54 is issued as a feedback signal to the controller 51. The subroutine shown in FIG. 7 is then completed, and the process returns to the main routine shown in FIG. 6.

As mentioned above, since the normal mode is in effect, the first flag Fa is then inverted from 0 to 1 (step ST08), and the second flag Fb is inverted from 0 to 1 (step ST09), as shown in FIG. 6. The target speed Ns and the actual speed Nr are then displayed in the display unit 45 shown in FIG. 5 (step ST10). The process then returns to step ST02.

When the sequence of steps ST02 through ST10 is repeated in this manner, the controller 51 maintains normal-mode speed control.

Figure 8:
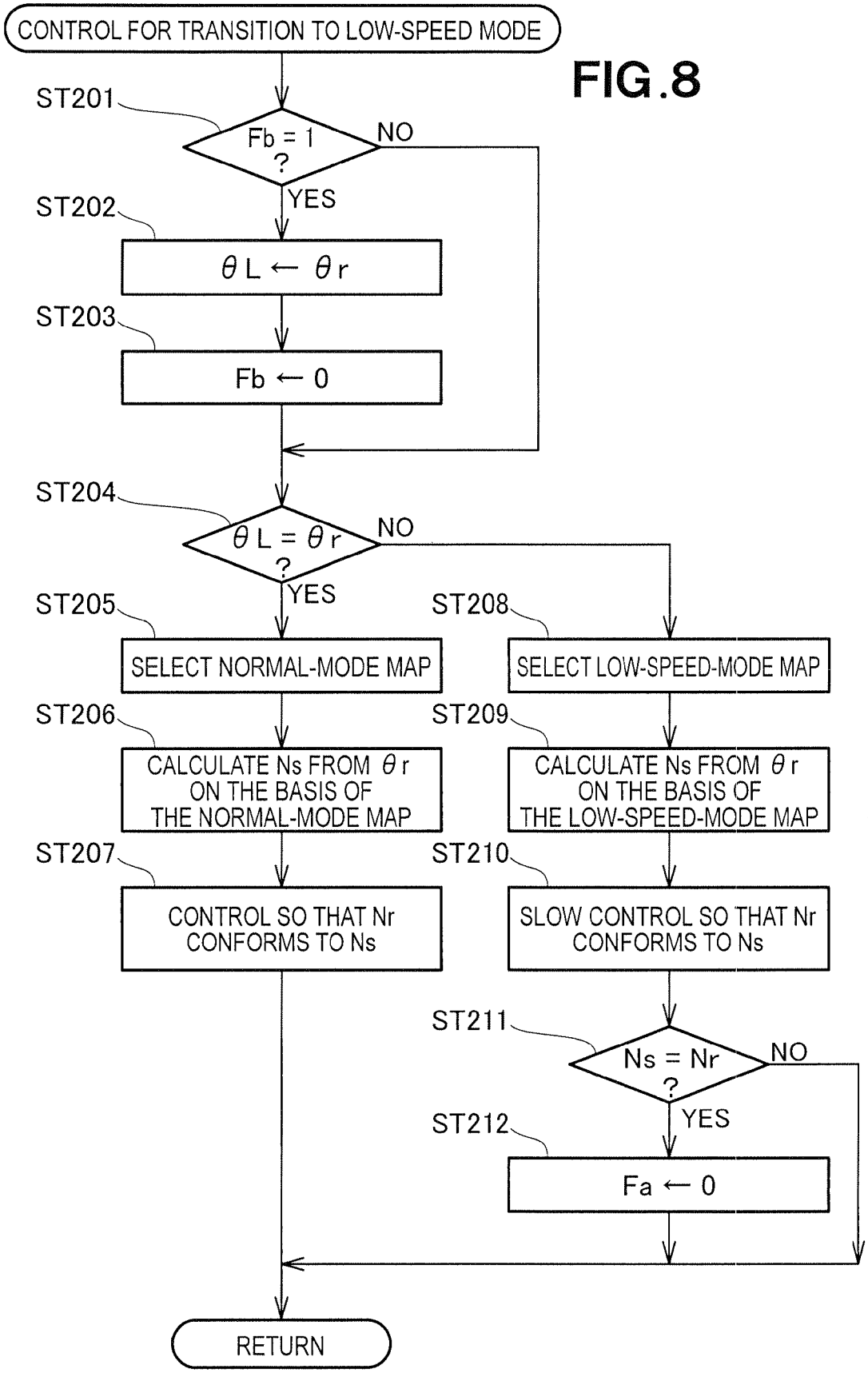
FIG. 8 is a flowchart showing a subroutine for executing transition control (step ST12) of the low-speed mode shown in FIG. 6.

When the pilot subsequently switches the low-speed mode switch unit 44 "on," the switch signal of the low-speed mode switch unit 44 changes to "on." A determination is therefore made in step ST05 that the switch signal of the low-speed mode switch unit 44 has changed to "on," i.e., that a switching signal has been received, and as a result, the low-speed mode is determined to be in effect. A determination is then made as to whether the first flag Fa=0 (step ST11). The first flag Fa had already been inverted from 0 to 1 in step ST08 described above. Therefore, a determination is made in step ST11 that the first flag Fa has inverted from 0 to 1, and as a result, a determination is made that the process is in an initial stage of transition to the low-speed mode. Control for transitioning to the low-speed mode is then executed (step ST12). FIG. 8 shows the details of the control (step ST12) for transitioning to the low-speed mode.

FIG. 8 is a control flowchart showing the subroutine for executing the control (step ST12) for transitioning to the low-speed mode shown in FIG. 6. In the subroutine shown in FIG. 8, a determination is first made as to whether the second flag Fb=1 (step ST201). The second flag Fb had already been inverted from 0 to 1 in step ST09 (see FIG. 6) described above. Therefore, a determination is made in step ST201 that the second flag Fb has inverted from 0 to 1.

When the determination that second flag Fb=1 is made in step ST201, the value of the reference manipulated variable θL of the grip 42 is set to the value of the actual manipulated variable θr (step ST202). The reference manipulated variable θL in step ST202 is the value used as a reference for determining whether the grip 42 was operated after the pilot switched on the low-speed mode switch unit 44. The actual manipulated variable θr of the current time in step ST202 is the target speed Ns of the time when the switch signal of the low-speed mode switch unit 44 was changed from "off" to "on" by the turning on of the low-speed mode switch unit 44.

The second flag Fb is then set to 0 (step ST203), and the process proceeds to step ST204. On the other hand, when the determination is made in step ST201 that the second flag Fb=0, the process proceeds to step ST204 while the original reference manipulated variable θL is maintained. In step ST204, a determination is made as to whether the actual manipulated variable θr matches the reference manipulated variable θL. When the values are determined to match (θL=θr) in step ST204, the "normal-mode map MN" is selected from the maps shown in FIG. 4 (step ST205).

The target speed Ns of the engine 14 is then calculated from the actual manipulated variable θr of the grip 42 on the basis of the normal-mode map MN (step ST206). The actual manipulated variable θr in step ST206 is the same value as the reference manipulated variable θL (θr=θL).

Normal-mode speed control is then maintained without modification (step ST207). In other words, the controller 51 controls the opening and closing of the throttle valve 53 so that the actual speed Nr conforms to the target speed Ns (the speed Ns calculated in step ST206) that corresponds to the manipulated variable θr. The controller 51 thus performs control so that the maintained target speed Ns of the time at which the switch signal low-speed mode switch unit 44 changed from "off" to "on" continues to be maintained. The subroutine shown in FIG. 8 is then completed, and the process returns to the main routine shown in FIG. 6. The target speed Ns and the actual speed Nr are then displayed in the display unit 45 shown in FIG. 5A or 5B (step ST10). The process then returns to step ST02.

The controller 51 thus continues to maintain normal-mode speed control when the sequences of steps ST02 through ST05, ST11 through ST12, and ST10 are repeated. In other words, the controller 51 performs control so that the actual manipulated variable θr immediately prior to the start of receiving the "on" signal is maintained when the "on" signal (switching signal) begins to be received from the low-speed mode switch unit 44. As a result, the controller 51 performs control so as to maintain the target speed Ns of the time immediately prior to the start of receiving the "on" signal.

When the pilot turns on (switches on) the low-speed mode switch unit 44, the "on" signal (switching signal) issued to the controller 51 is received from the low-speed mode switch unit 44. At this time, the controller 51 continues to maintain the maintained target speed Ns. There is therefore no sudden change in the target speed Ns at the time the low-speed mode switch unit 44 is switched. Since there is no sudden change of the speed Nr of the engine 14, the pilot can pilot the vessel more stably.

When the pilot operates the grip 42 after switching on the low-speed mode switch unit 44 as described above, the actual manipulated variable θr changes. Therefore, a determination is made in step ST204 that the actual manipulated variable θr does not match the reference manipulated variable θL (θL·θr), and as a result, a transition to the low-speed mode is determined to have occurred. The "low-speed-mode map ML" is therefore selected from the maps shown in FIG. 4 (step ST208). A new target speed Ns of the engine 14 is then calculated from the actual manipulated variable θr of the grip 42 on the basis of the low-speed-mode map ML (step ST209).

The opening and closing of the throttle valve 53 is then controlled so that the actual speed Nr conforms to the new target speed Ns (the speed Ns calculated in step S209) (step ST210). In step ST210, there is a gradual change from the maintained target speed Ns to the new target speed Ns. The "rate of change" at which the target speed Ns gradually changes is determined by setting the amount of change (ΔNs/Δt, acceleration deceleration) of the target speed Ns per unit time Δt to a small value. In other words, the speed of the change is more gradual than in the case of normal-mode speed control. The responsiveness of the change in the target speed Ns is low with respect to the speed at which the grip 42 is operated. Therefore, the controller 51 performs control so as to gradually change from the maintained target speed Ns to the target speed Ns that is in accordance with the changed manipulated variable θr.

After the pilot has turned on (switched on) the low-speed mode switch unit 44, the target speed Ns changes only when the grip 42 is intentionally rotated. The change in the target speed Ns is also gradual. The pilot can therefore pilot the vessel even more stably.

A determination is then made as to whether the actual speed Nr matches the target speed Ns (step ST211). When the determination is made in step ST211 that the actual speed Nr and the target speed Ns do not match, the first flag Fa is left unchanged, the subroutine shown in FIG. 8 is completed, and the process returns to the main routine shown in FIG. 6. The target speed Ns and the actual speed Nr are then displayed in the display unit 45 shown in FIG. 5 (step ST10). The process then returns to step ST02.

When the determination is made in step ST211 that the actual speed Nr and the target speed Ns match, the first flag Fa is inverted from 1 to 0 (step ST212), the subroutine shown in FIG. 8 is completed, and the process returns to the main routine shown in FIG. 6. The target speed Ns and the actual speed Nr are then displayed in the display unit 45 shown in FIG. 5 (step ST10). The process then returns to step ST02.

Figure 9:
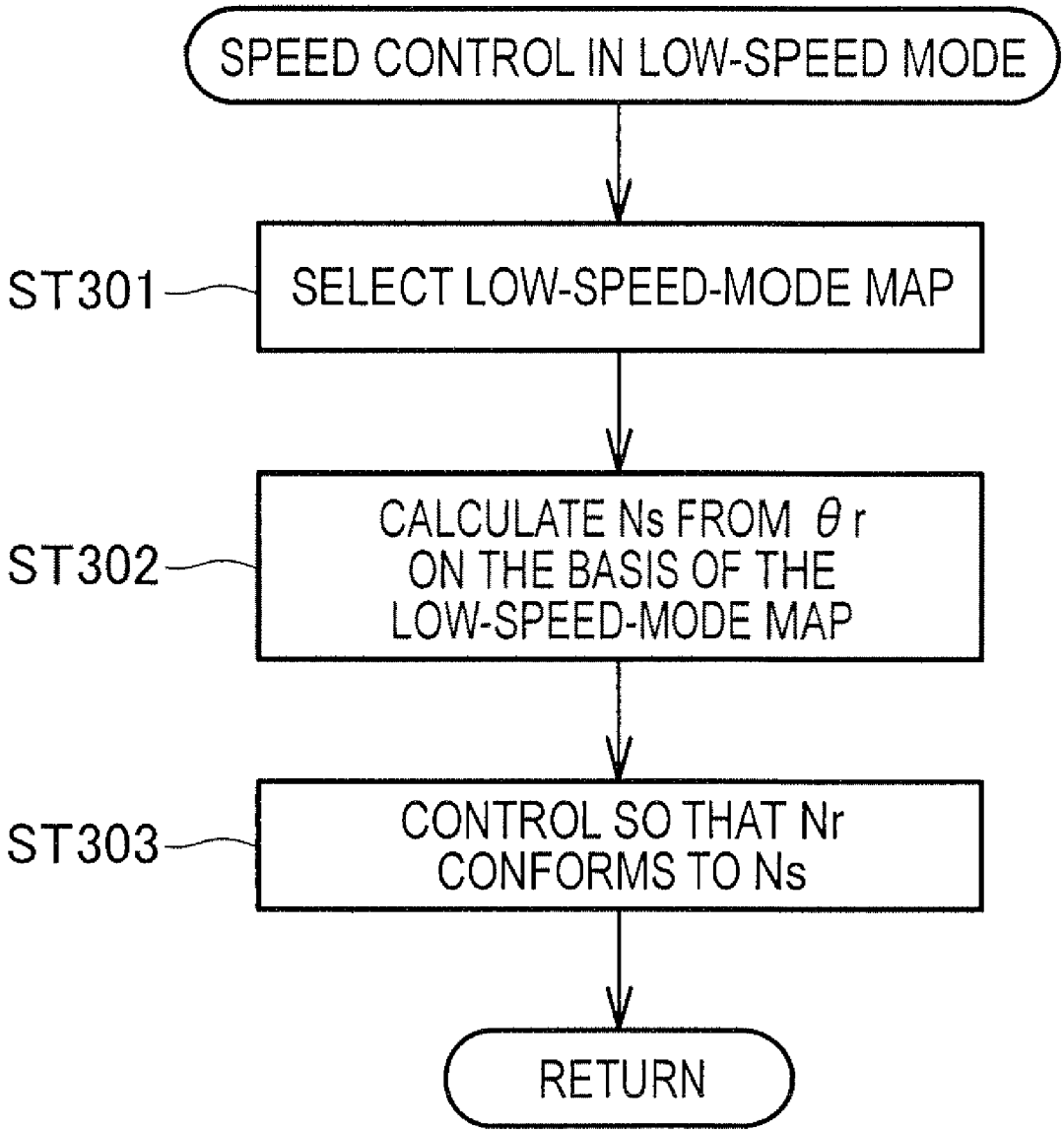
FIG. 9 is a flowchart showing a subroutine for executing speed control (step ST13) of the low-speed mode shown in FIG. 6.

A determination is then made in step ST11 shown in FIG. 6 that the first flag Fa has inverted from 1 to 0, and the speed is controlled in the low-speed mode (step ST13). FIG. 9 shows the details of speed control in the low-speed mode (step ST13).

FIG. 9 is a control flowchart showing a subroutine for controlling speed in the low-speed mode (step ST13) shown in FIG. 6. In the subroutine shown in FIG. 9, the "low-speed-mode map ML" is first selected from the maps shown in FIG. 4 (step ST301). The target speed Ns of the engine 14 is then calculated from the actual manipulated variable θr of the grip 42 on the basis of the low-speed-mode map ML (step S302).

The pilot then controls speed in the low-speed mode (step ST303). In other words, in step ST303, the pilot rotates the grip 42 as appropriate for the piloting conditions, and the controller 51 controls the opening and closing of the throttle valve 53 so that the actual speed Nr conforms to the target speed Ns (speed Ns calculated in step ST302) that corresponds to the manipulated variable θr. The subroutine shown in FIG. 9 is then completed, and the process returns to the main routine shown in FIG. 6.

As described above, since the outboard motor is in the low-speed mode, the third flag Fc is inverted from 0 to 1 (step ST14), and the fourth flag Fd is inverted from 0 to 1 (step ST15), as shown in FIG. 6. The target speed Ns and the actual speed Nr are then displayed in the display unit 45 shown in FIG. 5 (step ST10). The process then returns to step ST02.

When the sequence of steps ST02 through ST05, ST11, ST13 through ST15, and ST10 is repeated in this manner, the controller 51 continues to control speed in the low-speed mode.

Figure 10:
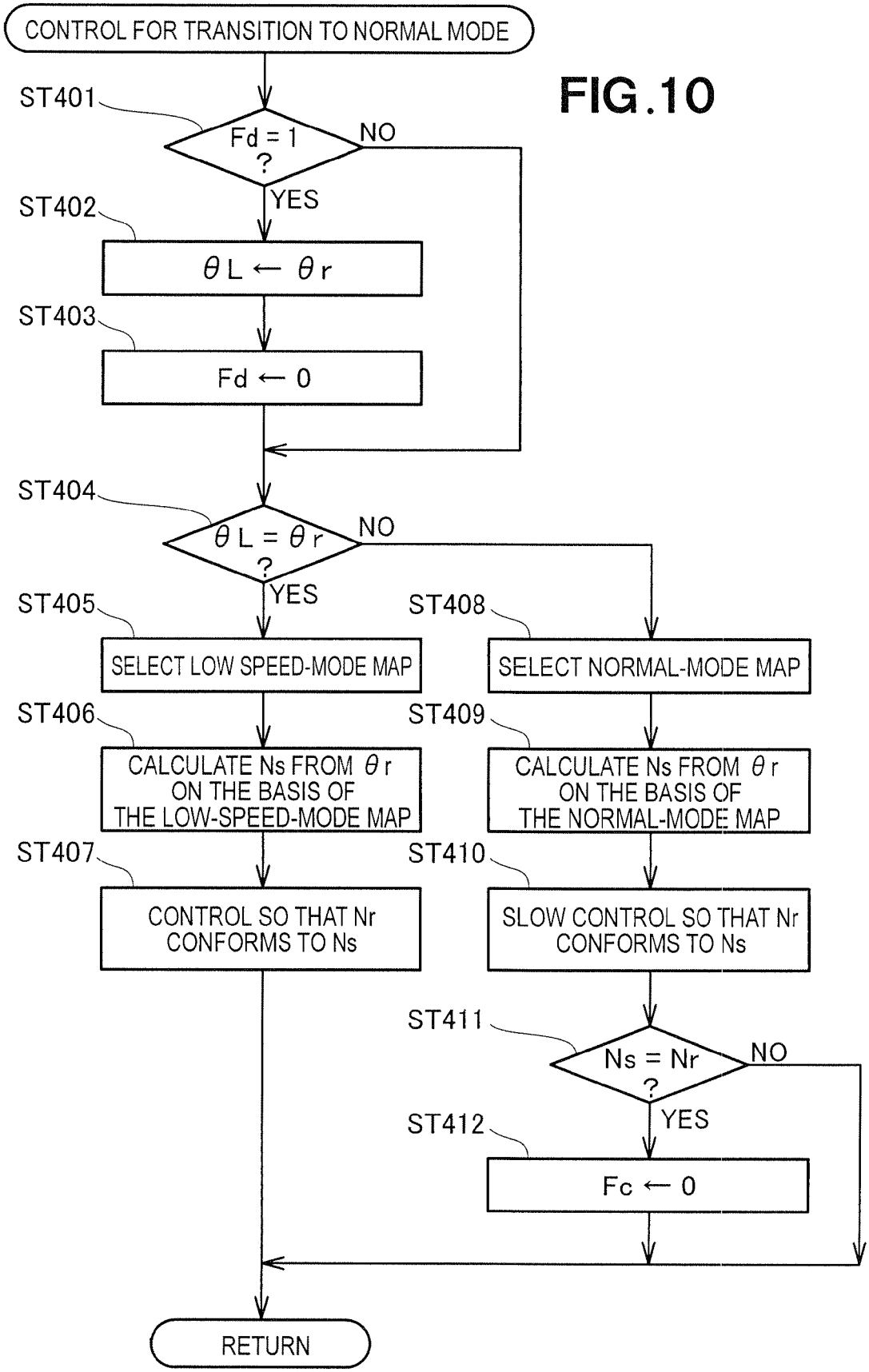
FIG. 10 is a flowchart showing a subroutine for executing transition control (step ST16) of the normal mode shown in FIG. 6.

When the pilot then returns the low-speed mode switch 44 to the "off" position, the switch signal of the low-speed mode switch 44 changes to "off." In step ST05, a determination is therefore made that the switch signal of the low-speed mode switch 44 has changed to "off," i.e., that the deactivating signal has been inputted. A determination is then made as to whether the third flag Fc=0 (step ST06). The third flag Fc had already been inverted from 0 to 1 in step ST14. Therefore, a determination is made in step ST06 that the third flag Fc has been inverted from 0 to 1, and as a result, a determination is made that the process is in an initial stage of returning to normal-mode speed control. Control for transitioning to the normal mode is then executed (step ST16). FIG. 10 shows the details of the control (step ST16) for transitioning to the normal mode.

FIG. 10 is a control flowchart showing the subroutine for executing the control (step ST16) for transitioning to the normal mode shown in FIG. 6. In the subroutine shown in FIG. 10, a determination is first made as to whether the fourth flag Fd=1 (step ST401). The fourth flag Fd had already been inverted from 0 to 1 in step ST15 (see FIG. 6) described above. Therefore, a determination is made in step ST401 that the fourth flag Fd has inverted from 0 to 1.

When the determination that the fourth flag Fd=1 is made in step ST401, the value of the reference manipulated variable θL of the grip 42 is set to the value of the actual manipulated variable θr of the current time (step ST402). The reference manipulated variable θL in step ST402 is the value used as a reference for determining whether the grip 42 was operated after the pilot switched off the low-speed mode switch 44. The actual manipulated variable θr of the current time in step ST402 is the target speed Ns of the time when the switch signal of the low-speed mode switch 44 was changed from "on" to "off" by the turning off of the low-speed mode switch 44.

The fourth flag Fd is then set to 0 (step ST403), and the process proceeds to step ST404. On the other hand, when the determination is made in step ST401 that the fourth flag Fd=0, the process proceeds to step ST404 while the original reference manipulated variable θL is maintained. In step ST404, a determination is made as to whether the actual manipulated variable θr matches the reference manipulated variable θL. When the values are determined to match (θL=θr) in step ST404, the "low-speed-mode map ML" is selected from the maps shown in FIG. 4 (step ST405).

The target speed Ns of the engine 14 is then calculated from the actual manipulated variable θr of the grip 42 on the basis of the low-speed-mode map ML (step ST406). The actual manipulated variable θr in step ST406 is the same value as the reference manipulated variable θL (θr=θL).

The speed continues to be controlled in the low-speed mode without modification (step ST407). In other words, the controller 51 controls the opening and closing of the throttle valve 53 so that the actual speed Nr conforms to the target speed Ns (the speed Ns calculated in step ST406) that corresponds to the manipulated variable θr. The controller 51 thus performs control so that the maintained target speed Ns continues to be maintained at the time at which the switch signal of the low-speed mode switch 44 cis hanged from "on" to "off". The subroutine shown in FIG. 10 is then completed, and the process returns to the main routine shown in FIG. 6. The target speed Ns and the actual speed Nr are then displayed in the display unit 45 shown in FIG. 5 (step ST10). The process then returns to step ST02.

The controller 51 thus continues to control speed in the low-speed mode when the sequences of steps ST02 through ST06, ST16, and ST10 are repeated. In other words, the controller 51 performs control so that the actual manipulated variable θr immediately prior to receiving the "off" signal is maintained when the "off" signal (deactivating signal) is received from the low-speed mode switch 44. As a result, the controller 51 performs control so as to maintain the target speed Ns of the time immediately prior to receiving the "off" signal.

When the pilot turns off (deactivates) the low-speed mode switch 44, the controller 51 receives the "off" signal (deactivating signal) issued from the low-speed mode switch 44. At this time, the controller 51 continues to maintain the maintained target speed Ns. There is therefore no sudden change in the target speed Ns at the time the low-speed mode switch 44 is deactivated. Since there is no sudden change of the speed Nr of the engine 14, the pilot can pilot the vessel more stably.

When the pilot operates the grip 42 after having switched off the low-speed mode switch unit 44 as described above, the actual manipulated variable θr changes. Therefore, a determination is made in step ST404 that the actual manipulated variable θr does not match the reference manipulated variable θL (θL≠θr), and as a result, a transition to the normal mode is determined to have occurred. The "normal-mode map MN" is therefore selected from the maps shown in FIG. 4 (step ST408). A new target speed Ns of the engine 14 is then calculated from the actual manipulated variable θr of the grip 42 on the basis of the normal-mode map MN (step ST409).

The opening and closing of the throttle valve 53 is then controlled so that the actual speed Nr conforms to the new target speed Ns calculated in step S409 (step ST410). In step ST410, there is a gradual change from the maintained target speed Ns to the new target speed Ns. The "rate of change" at which the target speed Ns gradually changes is determined by setting the amount of change (ΔNs/Δt, acceleration·deceleration) of the target speed Ns per unit time Δt to a small value. In other words, the speed of the change is more gradual than in the case of normal-mode speed control. The responsiveness of the change in the target speed Ns is low with respect to the speed at which the grip 42 is operated.

Therefore, the controller 51 performs control so as to gradually change from the maintained target speed Ns to the target speed Ns that is in accordance with the changed manipulated variable θr.

After the pilot has turned off (deactivated) the low-speed mode switch 44, the target speed Ns changes only when the grip 42 is intentionally rotated. The change in the target speed Ns is also gradual. The pilot can therefore pilot the vessel even more stably.

A determination is then made as to whether the actual speed Nr matches the target speed Ns (step ST411). When the determination is made in step ST411 that the actual speed Nr and the target speed Ns do not match, the third flag Fc is left unchanged, the subroutine shown in FIG. 10 is completed, and the process returns to the main routine shown in FIG. 6. The target speed Ns and the actual speed Nr are then displayed in the display unit 45 shown in FIG. 5 (step ST10). The process then returns to step ST02.

When the determination is made in step ST411 that the actual speed Nr and the target speed Ns match, the third flag Fc is inverted from 1 to 0 (step ST412), the subroutine shown in FIG. 10 is completed, and the process returns to the main routine shown in FIG. 6. The target speed Ns and the actual speed Nr are then displayed in the display unit 45 shown in FIG. 5 (step ST10). The process then returns to step ST02.

A determination is then made in step ST06 shown in FIG. 6 that the third flag Fc has inverted from 1 to 0, and normal-mode speed control is again executed (step ST07).

The controller 51 thus executes control for gradually returning to normal-mode speed control when the sequence of steps ST02 through ST06, ST16, and ST10 is repeated.

After the pilot has deactivated the low-speed mode switch 44, the pilot rotates the grip 42, whereby the target speed Ns changes according to the manipulated variable θr of the grip 42. In this case, the controller 51 performs control for gradually changing from the target speed Ns that had been maintained to the target speed Ns that is in accordance with the changed manipulated variable θr. After the pilot has (deactivated) the low-speed mode switch 44, the target speed Ns changes only when the grip 42 is intentionally rotated. The change in the target speed Ns is also gradual, and the pilot can therefore pilot the vessel even more stably.

Figure 11:
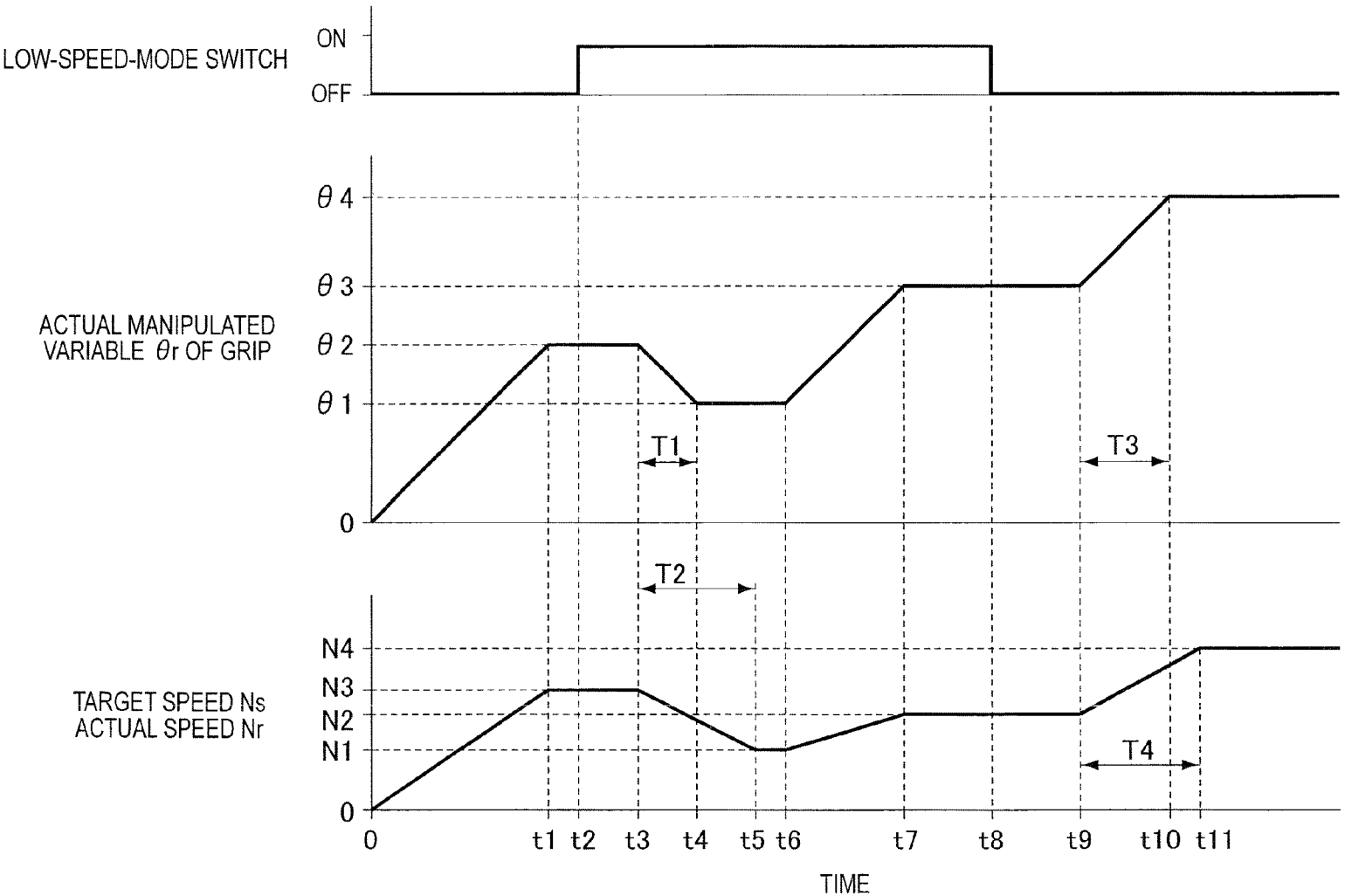
FIG. 11 is a time chart of an electronic governor and its components shown in FIG. 3.

The operation of the electronic governor 50 described in the control flowchart of FIG. 6 will next be described based on FIG. 11 and with reference to FIG. 3. FIG. 11 is a time chart of the electronic governor and components shown in FIG. 3. The relationship of the sizes of the actual manipulated variables θr is as follows: "$0<\theta 1<\theta 2<\theta 3<\theta 4$." The relationship of the sizes of the target speeds Ns and the actual speeds Nr is as follows: "$0<N1<N2<N3<N4$."

The target speed Ns changes according to the manipulated variable θr of the grip 42. The actual speed Nr changes so as to conform to the target speed Ns.

Since the low-speed mode switch 44 is off at this time, normal-mode control is in effect. In this state, the normal-mode map MN is selected from the maps shown in FIG. 4. When the pilot increases the manipulated variable θr from a value of 0 to θ2 during the time from time 0 to time t1, the target speed Ns and the actual speed Nr increase from 0 to N3 on the basis of the characteristics of the normal-mode map MN.

When the manipulated variable θr is then maintained at the value θ2, the target speed Ns and the actual speed Nr are maintained at the value N3. Then, when the low-speed mode switch 44 is turned on at time t2, a transition from the normal mode to the low-speed mode occurs. In this low-speed mode, the low-speed-mode map ML is selected from the maps shown in FIG. 4. However, since the manipulated variable θt is maintained at the value θ2, the target speed Ns and the actual speed Nr are maintained unchanged at N3.

When the pilot begins to reduce the manipulated variable θr to θ2 at time t3, the target speed Ns and the actual speed Nr begin to gradually decrease from N3. For example, the pilot reduces the manipulated variable θr from θ2 to θ1 over the course of the elapsed time T1 from time t3 to time t4. At this time, the target speed Ns and the actual speed Nr gradually decrease from N3 to N1 over the course of the elapsed time T2 from time t3 to time t5. The elapsed time T2 is longer than the elapsed time T1 (T2>T1).

When the manipulated variable θr is then maintained at θ1, the target speed Ns and the actual speed Nr are maintained at N1. When the pilot increases the manipulated variable θr from θ1 to θ3 from time t6 to time t7, the target speed Ns and the actual speed Nr increase from N1 to N2 on the basis of the characteristics of the low-speed-mode map ML. When the manipulated variable θr is subsequently maintained at θ3, the target speed Ns and the actual speed Nr are maintained at N2.

When the low-speed mode switch 44 is returned to "off" at time t8, a transition from the low-speed mode to the normal mode occurs. In the normal mode, the normal-mode map MN is selected from the maps shown in FIG. 4. However, wince the manipulated variable θr is maintained at θ3, the target speed Ns and the actual speed Nr are maintained unchanged at N2.

When the pilot begins to increase the manipulated variable θr from θ3 at time t9, the target speed Ns and the actual speed Nr begin to gradually increase from N2. For example, the pilot increases the manipulated variable θr from θ3 to θ4 over the course of the elapsed time T3 from time t9 to time t10. At this time, the target speed Ns and the actual speed Nr gradually increase from N2 to N4 over the course of the elapsed time T4 from time t9 to time t11. The elapsed time T4 is longer than the elapsed time T3 (T4>T3).

Following is a summary of the description given above. The steering handle 41 is provided with the rotatable grip 42 and the low-speed mode switch unit 44 (low-speed mode switch 44). The controller 51 sets the target speed Ns in accordance with the manipulated variable θr of the grip 42 detected by the grip operation detector 43, and controls the opening and closing of the throttle valve 53 so that the actual speed Nr conforms to the target speed Ns. The low-speed mode switch unit 44 issues an electrical switching signal ("on" signal) in accordance with the operations of the pilot. When the switching signal is being received from the low-speed mode switch unit 44, the controller 51 reduces the ratio at which the target speed Ns changes according to the manipulated variable θr relative to when the switching signal is not being received.

In other words, the ratio at which the target speed Ns changes according to the manipulated variable θr of the grip 42 is reduced by the simple operation of merely operating the low-speed mode switch unit 44. The target speed Ns does not increase even when the manipulated variable θr of the grip 42 is at maximum. The target speed Ns can therefore be finely adjusted. Since the speed Nr of the engine 14 can be finely adjusted in a low speed range, the speed of the vessel can be finely adjusted during trawling (trawl fishing). Even a novice can easily pilot the vessel. The low-speed mode switch unit 44 also merely issues an electrical switching signal in accordance with the operation of the pilot, and can therefore have a simple structure.

The low-speed mode switch unit 44 of the first embodiment is not limited to a rocker switch configuration, and may be a rotary switch or a push switch, for example.

FIGS. 12 through 16 show the outboard motor of a second embodiment. The outboard motor of the second embodiment differs from the outboard motor 10 of the first embodiment in that a constant-speed setting unit 144 is provided instead of the low-speed mode switch unit 44 provided to the grip 42. The other members of the outboard motor are the same as in the first embodiment, and are therefore referred to by the same reference symbols.

Figure 12:
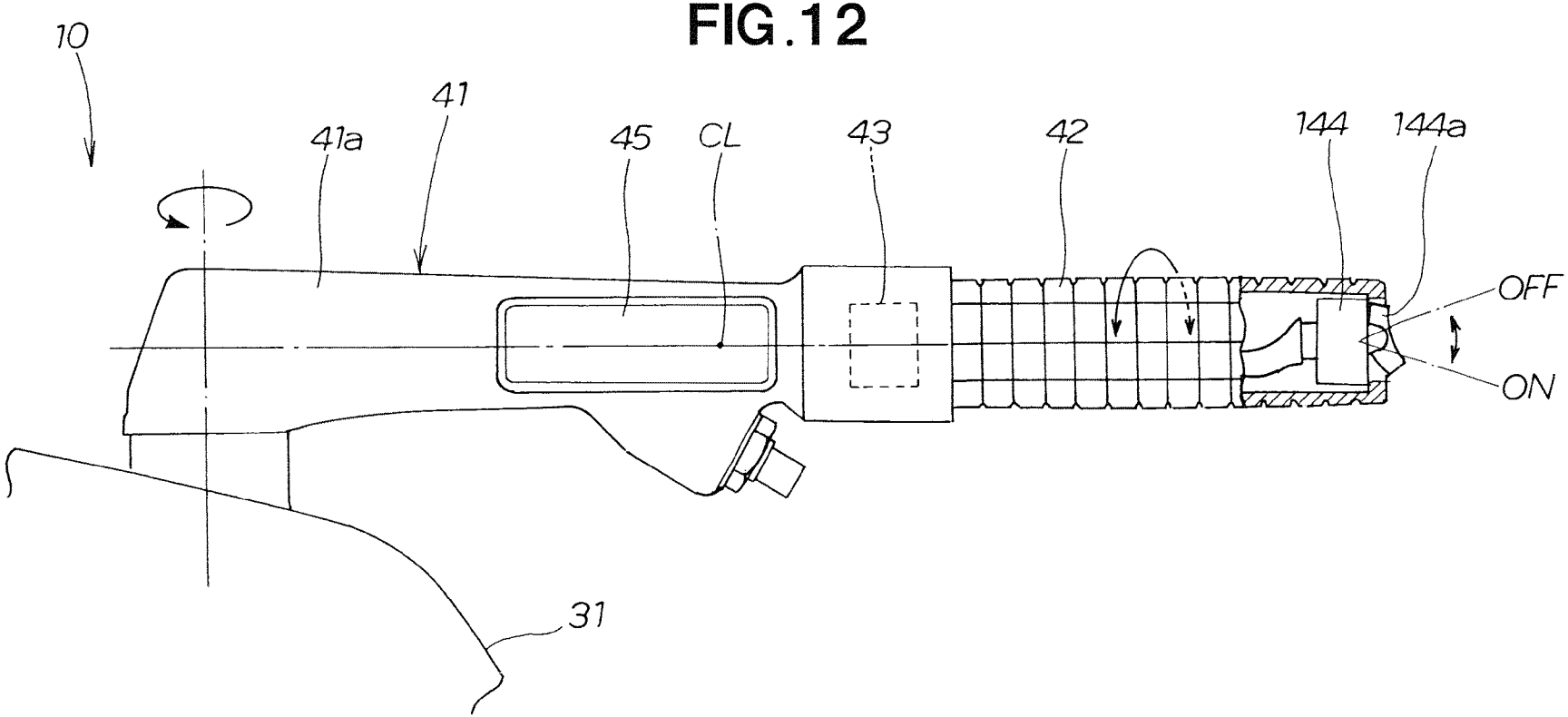
FIG. 12 is a top plan view showing a steering handle of an outboard motor according to a second embodiment of the present invention.

As shown in FIG. 12, the steering handle 41 is provided with the grip 42, the grip operation detector 43, the constant-speed setting unit 144, and the display unit 45.

The grip 42 is positioned at the distal end of the bar-shaped steering handle 41, and is attached so as to be able to rotate about the axis CL of the steering handle 41. The grip operation detector 43 detects the actual manipulated variable θr when the grip 42 is rotated, and is provided inside the steering handle 41. The grip operation detector 43 is composed of a variable resistor for issuing a voltage signal proportional to the manipulated variable θr (operation angle θr) of the grip 42.

The constant-speed setting unit 144 is set when the pilot wishes to maintain the speed of the engine 14 at an arbitrary constant value, and is composed of a manually operated switch operated by the pilot. Since the constant-speed setting unit 144 is formed by a manually operated switch positioned in the vicinity of the grip 42, the structure of the constant-speed setting unit 144 can be further simplified.

The manually operated switch is composed of a rocker switch, for example. This rocker switch is also referred to as a seesaw switch or a tumbler switch. In specific terms, the constant-speed setting unit 144 composed of a rocker switch is a switch whereby a connecting circuit is switched by pressing one side of an operating knob 144*a* that operates in seesaw fashion. The operating knob 144*a* is switched between two positions that include an "off" position and an "on" position at the other end of a seesaw operation from the "off" position, and the operating knob 144*a* maintains the switched position by itself even when no longer pressed after operation.

The switch signal issued by the constant-speed setting unit 144 is composed of two signals that include an "off" signal and an "on" signal. Specifically, when the operating knob 144*a* is in the "off" position, the constant-speed setting unit 144 issues the "off" signal (deactivating signal). When the operating knob 144*a* is in the "on" position, the constant-speed setting unit 144 issues the "on" signal (switching signal). The constant-speed setting unit 144 will be referred to hereinafter as the "cruise switch 144" as appropriate.

The constant-speed setting unit 144 is provided in a different position of the steering handle 41 than the grip 42. The constant-speed setting unit 144 is fixed to the distal end surface of the steering handle 41, for example. The constant-speed setting unit 144 can therefore be operated by the thumb of the hand holding the grip 42, for example.

The constant-speed setting unit 144 is preferably provided so that the operating knob 144*a* is operated vertically in seesaw fashion when the steering handle 41 is in the substantially horizontal use position. Through this arrangement, there is no change in the operation of the operating knob 144*a* regardless of whether the pilot is positioned to the left or the right (the front and back of the paper surface of FIG. 1) of the steering handle 41. The operability of the operating knob 144*a* is therefore enhanced.

It is sufficient insofar as the constant-speed setting unit 144 is provided in the vicinity of the grip 42 in the steering handle 41, and the constant-speed setting unit 144 may be provided closer to the swing base 41*a* than the grip 42 in the steering handle 41, for example.

Since the constant-speed setting unit 144 is provided to the steering handle 41 rather than to the outboard motor 10 as such, the constant-speed setting unit 144 is positioned closer to the pilot. The constant-speed setting unit 144 is therefore easy for the pilot to operate.

The display unit 45 is provided in the steering handle 41 closer to the swing base 41*a* than the grip 42, and on the upper surface of the handle.

The grip operation detector 43, the constant-speed setting unit 144, and the display unit 45 are thus provided to the steering handle 41 rather than to the outboard motor 10 as such, and are therefore less prone to water exposure.

Figure 13:
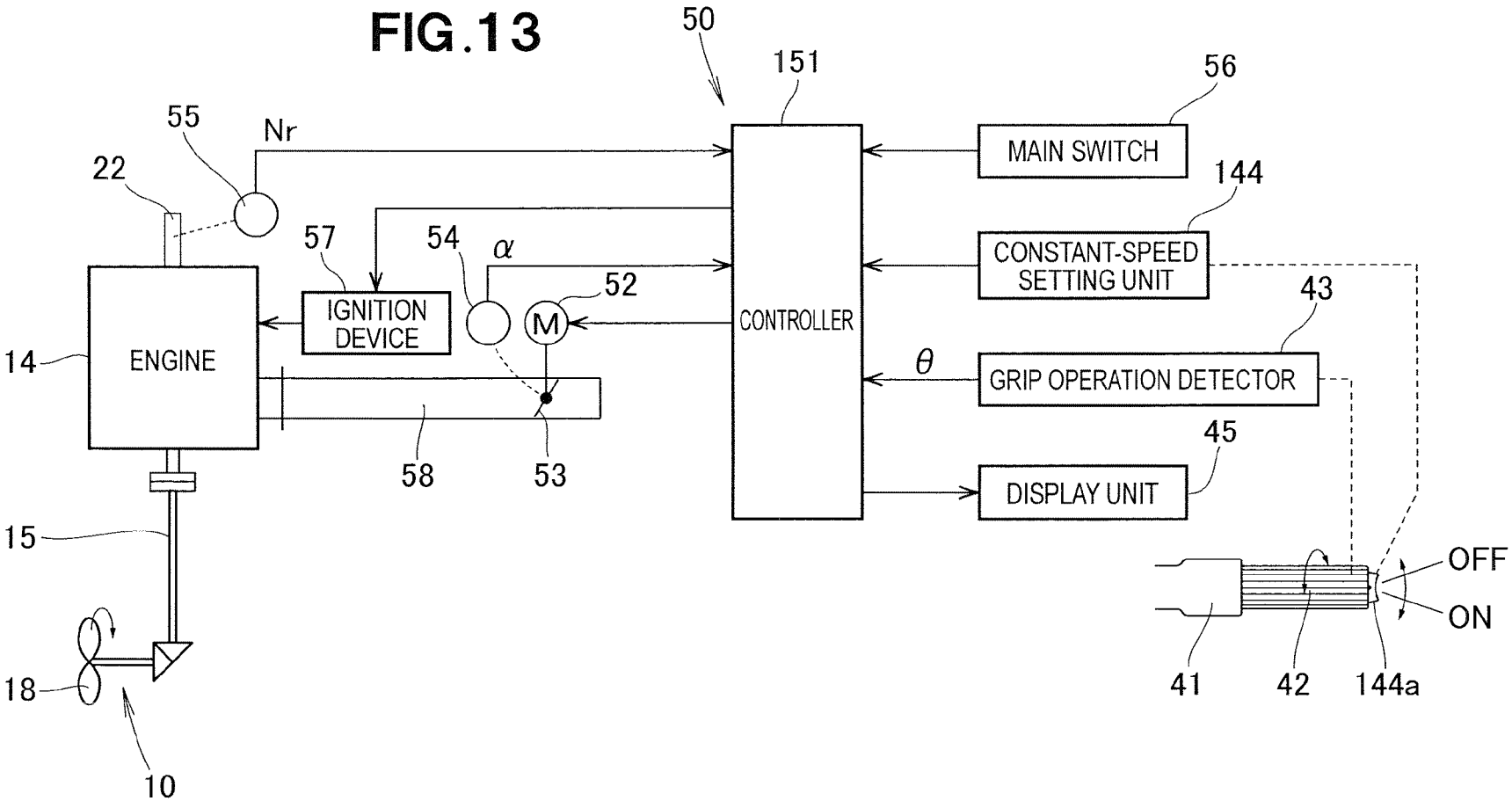
FIG. 13 is an electrical block diagram of the outboard motor according to the second embodiment.

As shown in FIG. 13, the outboard motor 10 is equipped with an electronic governor 50 (also referred to as an electric governor or an electronic speed regulator). The electronic governor 50 controls the speed of the engine 14 by automatically adjusting the degree of opening of the throttle valve 53 by an electric motor 52 on the basis of a control signal of a controller 151. The electronic governor 50 is formed by the combination of the controller 151, the electric motor 52, the throttle valve 53, a throttle opening degree sensor 54, and an engine speed sensor 55. The throttle opening degree sensor 54 detects the degree of opening α of the throttle valve 53. The engine speed sensor 55 detects the actual speed Nr of the engine 14.

The controller 151 is an electronic controller for receiving signals from the grip operation detector 43, the constant-speed setting unit 144, the throttle opening degree sensor 54, the engine speed sensor 55, and the main switch 56, and controlling the engine 14 according to a predetermined control mode, and is a microcomputer, for example. In other words, the controller 151 controls an ignition device 57, sets the target speed Ns in accordance with the manipulated variable θr (operation angle θr) of the grip 42 detected by the grip operation detector 43, and electrically controls the opening and closing of the throttle valve 53 via the electric motor 52 so that the actual speed Nr conforms to the target speed Ns.

Figure 14:
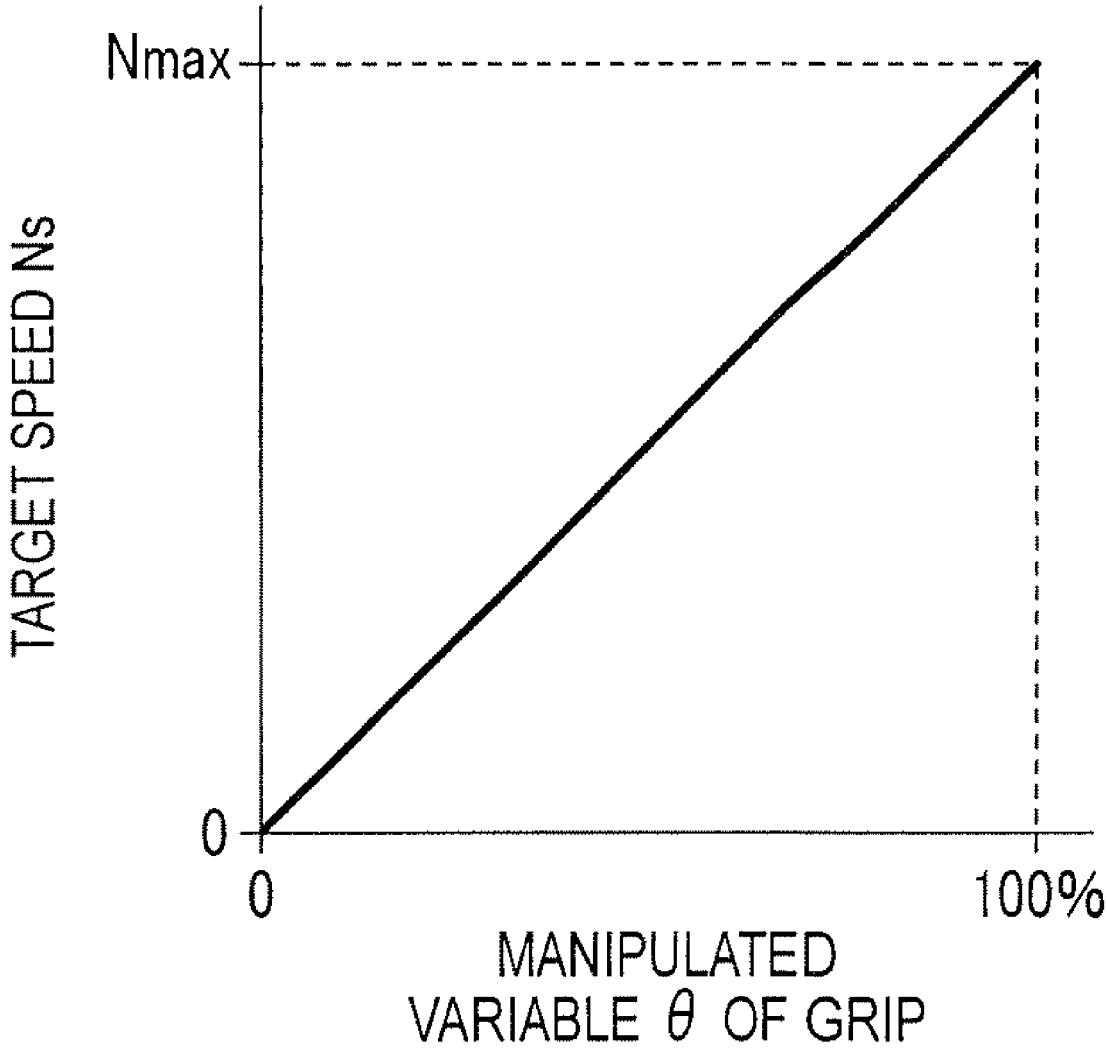
FIG. 14 is a map showing a target speed characteristic curve.

FIG. 14 shows the map used when the controller 151 shown in FIG. 13 increases and decreases the target speed. The map shows the characteristics of the target speed Ns with respect to the manipulated variable θr, wherein the horizontal axis indicates the actual manipulated variable θr of the grip 42, and the vertical axis indicates the target speed Ns of the engine. The map is a target speed characteristic curve that slopes upward to the right, and indicates that the target speed Ns varies with the manipulated variable θr.

According to this target speed characteristic curve shown in FIG. 14, it is apparent that the target speed Ns is at the minimum value of 0 when the manipulated variable θr is at the minimum value of 0, and the target speed Ns is at the maximum value Nmax when the manipulated variable θr is at the maximum value 100% (maximum angle). The target speed characteristic curve can be used as a map when the controller 151 calculates the target speed Ns according to the manipulated variable θr.

The controller 151 is configured so as to perform the following three types of control.

The first control is control performed so that the target speed Ns of the time at which an electrical setting signal ("on" signal) began to be inputted is maintained when the electrical setting signal ("on" signal) is being inputted from the constant-speed setting unit 144.

The second control is control performed so that the maintained target speed Ns continues to be maintained when inputting of the setting signal is ended.

The third control is control performed so as to gradually change from the maintained target speed Ns to a target speed Ns that is in accordance with a changed manipulated variable θr when the manipulated variable θr of the grip 42 has changed after the setting signal has ceased to be inputted.

The electric motor 52 (electric actuator 52) is composed of a stepping motor, for example. The throttle valve 53 is provided to an intake passage 58 for feeding combustion air to the engine 14. The amount of combustion air can be adjusted by the throttle valve 53. The main switch 56 turns the power supply to the engine 14 on and off, and is composed of an ignition switch for starting the engine 14.

The controller 151 issues a display instruction to the display unit 45, and the abovementioned target speed Ns and actual speed Nr are displayed in the display unit 45 shown in FIGS. 5A and 5B in the same manner as in the first embodiment.

Figure 15:
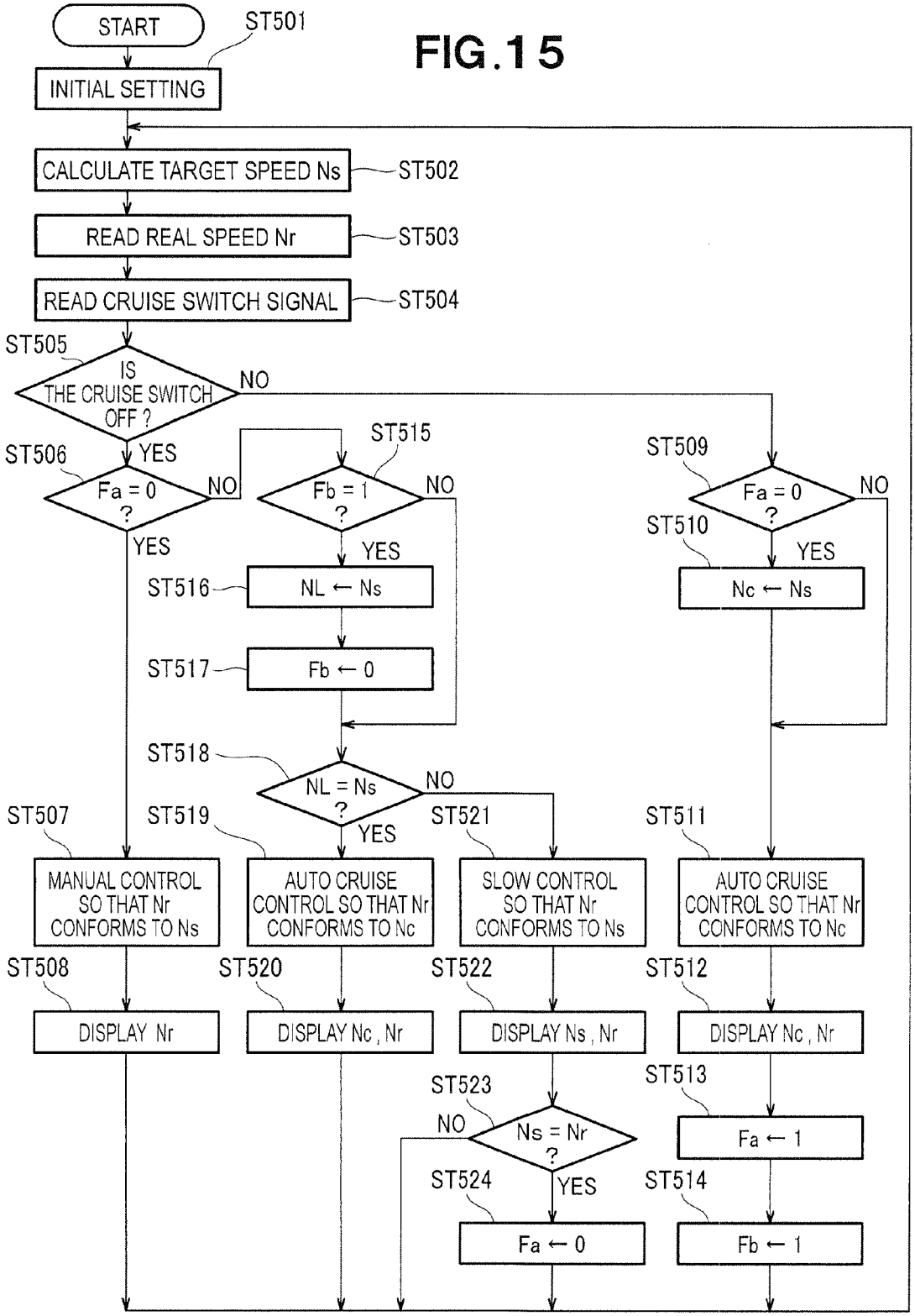
FIG. 15 is a flowchart showing an example control of a throttle valve by a controller of FIG. 13.

The flow of control when the controller 151 (FIG. 13) is a microcomputer will next be described based on FIG. 15 and with reference to FIG. 13. FIG. 15 is a control flowchart showing an example of the throttle valve control executed by the controller 151 shown in FIG. 13. After the pilot has started the engine 14 by switching the main switch 56 to the start position and actuating the ignition device 57, when the pilot switches the main switch 56 to the "on" position, the controller 151 initiates control according to the control flow shown in FIG. 15. Control by the controller 151 is then ended by the pilot switching the main switch 56 to the "off" position. This control flow is a closed-loop control flow executed repeatedly at each instance of a predetermined time, e.g., 20 msec. The control flow will be described below.

The cruise switch 144 at this time is in the "off" state. In this state, the pilot switches the main switch 56 to the "on" position. When the main switch 56 is turned on, the controller 151 initiates control after an initialization (step ST501). In other words, the system is reset, the first flag Fa and the second flag Fb are set to 0, and a cruise target speed Nc and a reference target speed NL are set to a value of 0.

The target speed Ns of the engine 14 is then calculated (step ST502). Specifically, the manipulated variable θr of the grip 42 is read, and the target speed Ns of the engine 14 is calculated based on the manipulated variable θr (step ST502). This calculation can be performed through the use of the map shown in FIG. 14, for example. The target speed Ns may also be calculated from the manipulated variable θr by computation. The manipulated variable θr of the grip 42 is detected by the grip operation detector 43.

The actual speed Nr of the engine 14 is then read (step ST503). The actual speed Nr is detected by the engine speed sensor 55. The switch signal of the cruise switch 144 is then read (step ST504). A determination is then made as to whether the switch signal of the cruise switch 144 is "off" (step ST505). When the switch signal is determined to be "off" in step ST505, a determination is made as to whether the first flag Fa=0 (step ST506).

When the switch signal is "off" in step ST505, and the first flag Fa=0 in step ST506, the normal speed control mode is determined to be in effect, and normally speed control by the pilot is executed (step ST507). In other words, in step ST507, the pilot rotates the grip 42 as appropriate for the piloting conditions, and the controller 151 controls the opening and closing of the throttle valve 53 so that the actual speed Nr conforms to the target speed Ns (speed Ns calculated in step ST502) that corresponds to the manipulated variable θr. Specifically, the opening and closing of the throttle valve 53 are controlled by controlling the driving of the electric motor 52 by PID control or the like. A signal of the opening degree α detected by the throttle opening degree sensor 54 is issued as a feedback signal to the controller 151.

The actual speed Nr is displayed in the display unit 45 (step ST508). The process then returns to step ST502.

The controller 151 maintains control in the normal speed control mode when the sequence of steps ST02 through ST08 is repeated in this manner.

When the pilot subsequently switches the cruise switch 144 "on," the switch signal of the cruise switch 144 changes to "on." A determination is therefore made in step ST505 that the switch signal of the cruise switch 144 has changed to "on," i.e., that a setting signal has been inputted, and as a result, the auto cruise control mode is determined to be in effect. A determination is then made as to whether the first flag Fa=0 (step ST509).

When a determination is made that the switch signal is "on" in step ST505, and the first flag Fa=0 in step ST509, the value of the cruise target speed Nc is set to the value of the target speed Ns of the current time (step ST510), and the process proceeds to step ST511. The target speed Ns of the current time is the value calculated in step ST502. When the determination that the first flag Fa=1 is made in step ST509, the process proceeds to step ST511 while the original value of the cruise target speed Nc that had been set prior to the current time is maintained.

Since the auto cruise control mode is in effect, auto cruise speed control is then executed (step ST511). In other words, the opening and closing of the throttle valve 53 are controlled in step ST511 so that the actual speed Nr conforms to the cruise target speed Nc. Specifically, the opening and closing of the throttle valve 53 are controlled by controlling the driving of the electric motor 52 by PID control or the like. When an "on" switch signal (setting signal) is being inputted from the cruise switch 144, the controller 151 thus performs control so as to maintain the target speed Ns (i.e., the cruise target speed Nc) of the time when inputting began.

The cruise target speed Nc (the target speed Ns of the time when inputting of the "on" signal from the cruise switch 144 began) and the actual speed Nr are then displayed in the display unit 45 (step ST512). In the plurality of display segments 45*a*, 45*c* of the display unit 45 shown in FIGS. 5A and 5B, for example, the display segment 45Ns indicated by the hatching pattern displays the target speed Ns, and the display segment 45Nr indicated by the spotted pattern displays the actual speed Nr.

As described above, since the auto cruise control mode is in effect, the first flag Fa is then inverted from 0 to 1 (step ST513), and the second flag Fb is inverted from 0 to 1 (step ST514). The process then returns to step ST502.

The controller 151 maintains control in the auto cruise control mode when the sequence of steps ST502 through ST505, and ST509 through ST514 is repeated in this manner.

When the pilot then returns the cruise switch 144 to the "off" position, the switch signal of the cruise switch 144 changes to "off." A determination is therefore made in step ST505 that the switch signal of the cruise switch 144 has changed to "off," i.e., that a deactivating signal has been inputted. A determination is then made as to whether the first flag Fa=0 (step ST506). The first flag Fa had already been inverted from 0 to 1 in step ST513 described above. Therefore, a determination is made in step ST506 that the first flag Fa has inverted from 0 to 1, and as a result, a determination is made that the process is in an initial stage of returning to the normal speed control mode.

Since an initial state is in effect for returning to the normal speed control mode, a determination is made as to whether the second flag Fb=1 (step ST515). The second flag Fb had already been inverted from 0 to 1 in step ST514. The second flag Fb is therefore determined in step ST515 to have inverted from 0 to 1.

When the determination that the second flag Fb=1 is made in step ST515, the value of the reference target speed NL is set to the value of the target speed Ns of the current time (step ST516). The reference target speed NL is a value used as a reference for determining whether the grip 42 was operated after the pilot switched the cruise switch 144 back to "off." The target speed Ns of the current time in step ST516 is the target speed Ns of the time at which the switch signal of the cruise switch 144 was inverted from "on" to "off" by the return of the cruise switch 144 to the "off" state.

The second flag Fb is then inverted back from 1 to 0 (step ST517), and the process proceeds to step ST518). When the determination that the second flag Fb=0 is made in step ST515, the process proceeds to step ST518 while the original value of the reference target speed NL is maintained.

A determination is then made as to whether the target speed Ns matches the reference target speed NL (step ST518). When the determination that the target speed Ns matches the reference target speed NL (NL=Ns) is made in step ST518, The same control as in step ST511 is executed, i.e., auto cruise speed control is maintained unchanged. The controller 151 performs control so as to continue to maintain the maintained target speed Ns of the time at which the "on" signal ceased to be inputted from the cruise switch 144.

The cruise target speed Nc (the target speed Ns of the time when inputting from the cruise switch 144 began) and the actual speed Nr are displayed in the display unit 45 (step ST520). The process then returns to step ST502.

When the sequence of steps ST502 through ST506, and steps ST515 through ST520 is repeated in this manner, the controller 151 continues to maintain control according the auto cruise control mode in the initial stage for returning to the normal speed control mode.

The "on" signal (setting signal) issued from the cruise switch 144 to the controller 151 ends when the pilot turns off (deactivates) the cruise switch 144. At this time, the controller 151 continues to maintain the maintained target speed Ns. There is therefore no sudden change in the target speed Ns at the time the cruise switch 144 is deactivated. Since there is no sudden change of the speed Nr of the engine 14, the pilot can pilot the vessel more stably.

When the pilot operates the grip 42 after having switched off the cruise switch 144 as described above, the actual manipulated variable θr changes, and the target speed Ns changes as a result. Therefore, in step ST518, a determination is made that the target speed Ns does not match the reference target speed NL (NL≠Ns), and as a result, a transition to the normal speed control mode is determined to have occurred, and the process proceeds to step ST521.

The opening and closing of the throttle valve 53 is then controlled so that the actual speed Nr conforms to the target speed Ns that is in accordance with the changed manipulated variable θr (step ST521). In step ST521, there is a gradual change from the maintained target speed Ns to the new target speed Ns that is in accordance with the changed manipulated variable θr.

The "rate of change" for gradually changing from the maintained target speed Ns to the target speed Ns in accordance with the changed manipulated variable θr is determined by setting the amount of change (ΔNs/Δt, acceleration deceleration) of the target speed Ns per unit time Δt to a small value. In other words, the speed of the change is more gradual than in the case of the normal speed control mode. The responsiveness of the change in the target speed Ns is low with respect to the speed at which the grip 42 is operated. Therefore, the controller 151 performs control so as to gradually change from the maintained target speed Ns to the new target speed Ns that is in accordance with the changed manipulated variable θr.

The target speed Ns and the actual speed Nr are then displayed in the display unit 45 (step ST522). A determination is then made as to whether the actual speed Nr matches the target speed Ns (step ST523). When the determination that the actual speed Nr and the target speed Ns do not match is made in step ST523, the first flag Fa is left unchanged, and the process returns to step ST502. The sequence of steps ST502 through ST506, ST515 through ST518, and ST521 through ST523 is therefore repeated.

When the sequence of steps ST502 through ST506, ST515 through ST518, and ST521 through ST523 is repeated in this manner, the controller 151 executes control for gradually returning to the normal speed control mode.

The pilot rotates the grip 42 after deactivating the cruise switch 144, and the target speed Ns thereby changes according to the manipulated variable θr of the grip 42. In this case, the controller 151 performs control so as to gradually change from the maintained target speed Ns to a target speed Ns that is in accordance with the changed manipulated variable θr. After the pilot has deactivated the cruise switch 144, the target speed Ns changes only when the grip 42 is intentionally rotated. The change in the target speed Ns is also gradual. The pilot can therefore pilot the vessel even more stably.

When the determination that the actual speed Nr and the target speed Ns match is made in step ST523, the first flag Fa is inverted from 1 to 0 (step ST524), and the process then returns to step ST502. The determination is then made in step ST506 that the first flag Fa has inverted from 1 to 0, and the process proceeds to step ST507. As a result, the controller 151 executes control according to the normal speed control mode. In other words, the sequence of steps ST502 through ST508 is repeated.

Figure 16:
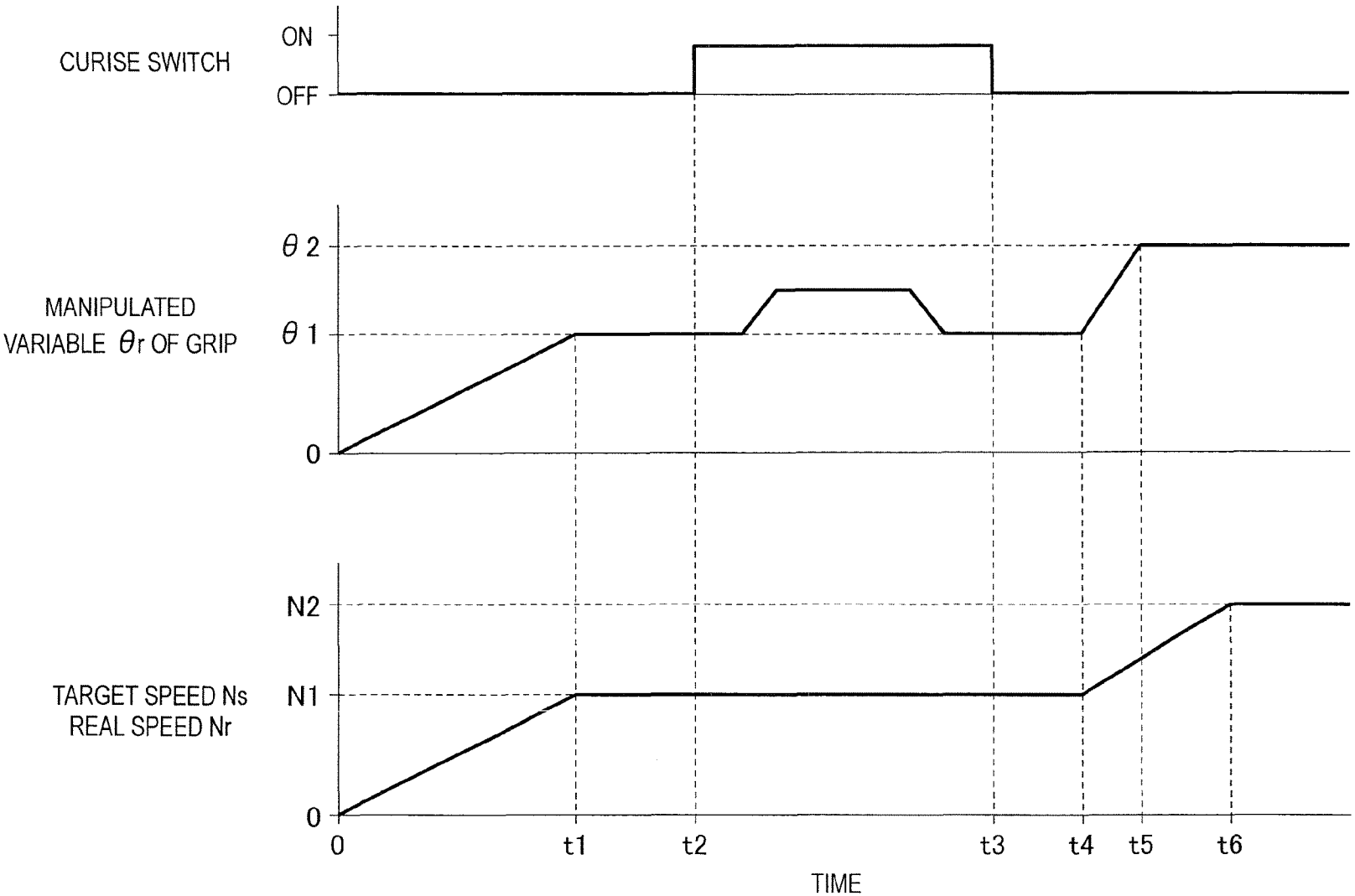
FIG. 16 is a time chart of an electronic governor and its components shown in FIG. 13.

FIG. 16 is a time chart in which time is indicated on the horizontal axis.

When the cruise switch 144 is "off," the target speed Ns changes according to the manipulated variable θr of the grip 42. As a result, the actual speed Nr changes so as to conform to the target speed Ns. For example, when the manipulated variable θr increases from 0 to θ1 within the time period from 0 to time t1, the target speed Ns and the actual speed Nr increase from 0 to N1. When the manipulated variable θr is subsequently maintained at θ1, the target speed Ns and the actual speed Nr remain at N1.

When the cruise switch 144 is turned "on" at time t2, the target speed Ns is maintained at the value N1 at time t2. The actual speed Nr is therefore also maintained at the same value of N1. When the cruise switch 144 is in the "on" state, the target speed Ns does not change even when the manipulated variable θr of the grip 42 changes.

Even when the cruise switch 144 is returned to "off" at time t3, the target speed Ns is maintained at the value N1 of time t2 as long as there is no change in the manipulated variable θr of the grip 42. The actual speed Nr is therefore maintained at the value of N1.

The manipulated variable θr of the grip 42 changes from θ1 to θ2 during the time period from time t4 to time t5. However, the target speed Ns gradually changes from N1 to N2 over the course of the time period from time t4 to time t6. The time from t4 and t6 is longer than the time from t4 to t5.

The second embodiment is summarized below.

The steering handle 41 is provided with the rotatable grip 42 and the constant-speed setting unit (cruise switch) 144.

The controller 151 sets the target speed Ns according to the manipulated variable θr of the grip 42 detected by the grip operation detector 43, and controls the opening and closing of the throttle valve 53 so that the actual speed Nr conforms to the target speed Ns. The constant-speed setting unit 144 issues an electrical setting signal ("on" signal) in accordance with the operations of the pilot. When the electrical setting signal is being inputted from the constant-speed setting unit 144, the controller 151 maintains the target speed Ns of the time at which inputting began. In other words, the speed Nr of the engine 14 can be kept constant by the simple operation of merely operating the constant-speed setting unit 144. It is therefore easy to pilot the vessel. The constant-speed setting unit 144 also merely issues an electrical setting signal in accordance with the operation of the pilot, and can therefore have a simple structure.

The constant-speed setting unit 144 of the second embodiment is not limited to a rocker switch configuration, and may be a rotary switch or a push switch, for example.

The outboard motor 10 of the present invention is suitable for use in various types of hulls Si having sizes from small to relatively large.

Obviously, various minor changes and modifications of the present invention are possible in light of the above teaching. It is therefore to be understood that within the scope of the appended claims the invention may be practiced otherwise than as specifically described.

What is claimed is:

1. An outboard motor in which opening/closing of a throttle valve is electrically controlled such that an actual speed of an engine for driving a propeller conforms to a target speed, the outboard motor comprising:

a manually operatable low-speed mode switch unit provided in a steering handle;

a rotatable grip provided at a distal end of the steering handle;

a grip operation detector for detecting a manipulated variable of the grip; and a controller for setting the target speed in accordance with the manipulated variable detected by the grip operation detector and controlling the opening/closing of the throttle valve so that the actual speed conforms to the target speed, wherein the controller performs control such that when a switching signal is received from the low-speed mode switch unit, a ratio at which the target speed varies with the manipulated variable decreases in comparison with when the switching signal is not received.

2. The outboard motor of claim 1, wherein the controller performs control so as to maintain the target speed of a time immediately prior to when the switching signal had ceased to be received, at a time at which the switching signal is no longer received from the low-speed mode switch unit.

3. The outboard motor of claim 2, wherein the controller is arranged to perform control so as to gradually change from the maintained target speed to a target speed that is in accordance with a changed manipulated variable when the manipulated variable has changed after the switching signal has ceased to be received from the low-speed mode switch unit.

4. The outboard motor of claim 1, wherein the low-speed mode switch unit comprises a manually operated switch disposed in a vicinity of the grip.

5. The outboard motor of claim 1, wherein the steering handle is provided with a display unit for displaying the actual speed and the target speed.

6. An outboard motor in which opening/closing of a throttle valve is electrically controlled such that an actual speed of an engine for driving a propeller conforms to a target speed, the outboard motor comprising:

a manually operatable constant-speed setting unit provided in a steering handle;

a rotatable grip provided at a distal end of the steering handle;

a grip operation detector for detecting a manipulated variable of the grip; and a controller for setting the target speed in accordance with the manipulated variable detected by the grip operation detector and controlling the opening/closing of the throttle valve so that the actual speed conforms to the target speed, wherein the controller performs control such that the target speed at a time the constant-speed setting unit changes from off to on is maintained when the constant-speed setting unit is on even when the manipulated variable changes.

7. The outboard motor of claim 6, wherein the controller performs control so that the maintained target speed continues to be maintained unchanged at the time the constant-speed setting unit changes from on to off.

8. The outboard motor of claim 7, wherein the controller performs control so that the maintained target speed gradually changes to a target speed that is in accordance with a changed manipulated variable when the manipulated variable has changed after the constant-speed setting unit has changed from from on to off.

9. The outboard motor of claim 6, wherein the constant-speed setting unit comprises a manually operated switch disposed in the vicinity of the grip.

10. The outboard motor of claim 6, wherein the steering handle is provided with a display unit for displaying the actual speed and the target speed.

* * * * *